US007069872B2

(12) United States Patent
Ostreng et al.

(10) Patent No.: US 7,069,872 B2
(45) Date of Patent: Jul. 4, 2006

(54) FLOATING DRIVE-ON-WATERCRAFT DOCK

(75) Inventors: Troy Ostreng, Nixa, MO (US); Lawrence Moody, Monett, MO (US)

(73) Assignee: E-Z-Dock, Inc., Monett, MO (US)

( * ) Notice: Subject to any disclaimer, the term of this patent is extended or adjusted under 35 U.S.C. 154(b) by 0 days.

(21) Appl. No.: 11/051,418

(22) Filed: Feb. 4, 2005

(65) Prior Publication Data

US 2005/0172876 A1 Aug. 11, 2005

Related U.S. Application Data

(63) Continuation-in-part of application No. 29/211,862, filed on Aug. 23, 2004, which is a continuation-in-part of application No. 29/211,860, filed on Aug. 23, 2004, which is a continuation-in-part of application No. 29/211,867, filed on Aug. 23, 2004.

(60) Provisional application No. 60/542,140, filed on Feb. 6, 2004.

(51) Int. Cl.
*B63B 35/40* (2006.01)

(52) U.S. Cl. ..... 114/263; 114/77 R

(58) Field of Classification Search ..... 114/77 R, 114/263, 44–47
See application file for complete search history.

(56) References Cited

U.S. PATENT DOCUMENTS 3,734,046 A * 5/1973 Schmidt et al. ..... 114/259
3,824,644 A 7/1974 Stranzinger
4,604,962 A 8/1986 Guibault
4,773,346 A * 9/1988 Blanding et al. ..... 114/45
5,281,055 A 1/1994 Neitzke et al.
5,529,013 A 6/1996 Eva, III et al.
5,682,833 A 11/1997 Eva, III et al.
D398,576 S 9/1998 Hillman et al.
5,855,180 A 1/1999 Masters
5,931,113 A 8/1999 Eva, III et al.
5,941,660 A * 8/1999 Rueckert ..... 405/7
5,947,050 A 9/1999 Eva, III et al.
6,006,687 A 12/1999 Hillman et al.
6,431,106 B1 8/2002 Eva, III et al.
6,526,902 B1 3/2003 Faber
6,592,291 B1 * 7/2003 Foxwell ..... 405/1
6,602,022 B1 8/2003 Wilkins
6,745,714 B1 6/2004 Faber

OTHER PUBLICATIONS

Pamphlet/1998, EZ Dock, Inc. —EZ Dock Dock system, EZ Port Boat Lifts, EZ Port PWC Lifts, 8 pages.

* cited by examiner

*Primary Examiner*—Sherman Basinger
(74) *Attorney, Agent, or Firm*—Polster, Lieder, Woodruff & Lucchesi, L.C.

(57) ABSTRACT

A floating drive-on watercraft dock comprises a one-piece molded body defining a watercraft receiving area. The watercraft receiving area includes roller assemblies on the bottom of the watercraft receiving area and glide assemblies on the sides of the watercraft receiving area. The roller and glide assemblies can be easily removed and replaced for servicing of the watercraft dock. An extension unit is provided which can be connected to the watercraft dock body. The extension unit includes an extension body and a tongue extending from the extension body. The tongue is sized and shaped to have a bottom surface complementary to the entrance to the watercraft receiving area of the watercraft dock body. The extension unit also includes a watercraft receiving area, which, when the extension unit is connected to the watercraft dock, increases the length of the watercraft receiving area.

32 Claims, 16 Drawing Sheets

FLOATING DRIVE-ON-WATERCRAFT DOCK

CROSS-REFERENCE TO RELATED APPLICATIONS

This application claims priority to Provisional Application No. 60/542,140 filed Feb. 6, 2004, entitled Personal Watercraft Dock, and which is incorporated herein by reference. This application is also a Continuation-In-Part of application Ser. No. 29/211,862, filed Aug. 23, 2004 and entitled Floating Drive-On Boat Dock; application Ser. No. 29/211,860, filed Aug. 23, 2004 and entitled Floating Drive-On Boat Dock Extension; and application Ser. No. 29/211,867, filed Aug. 23, 2004 and entitled Extended Floating Drive-On Boat Dock, all of which are incorporated herein by reference.

STATEMENT REGARDING FEDERALLY SPONSORED RESEARCH OR DEVELOPMENT

Not Applicable.

BACKGROUND OF THE INVENTION

This invention relates to floating docks, piers, etc., and, in particular, to a floating drive-on watercraft dock on which watercraft, such as personal watercraft and small boats can be dry-docked.

Watercraft docks commonly comprise pilings which are embedded in the floor of a body of water (such as a lake, river, ocean, etc.) to which a wooden deck is secured. Such docks, piers, etc. are difficult and time consuming to construct and require significant upkeep. Additionally, if the dock is not a floating dock, it is further subject to the rise and fall of the water level of the water body in which the dock is located.

Plastic docks were introduced to overcome some of the problems associated with wooden docks and piers. Such docks do not require the upkeep that is necessary for wooden docks. An example of such a modular dock is shown in U.S. Pat. No. 5,281,055, which is incorporated herein by reference. The floating modular dock described in the just noted patent is a dock section or dock building block, and several of the dock sections can be connected together to form a dock of a desired size and shape. Various components have been introduced which can be added to plastic docks. A commonly desired add-on for docks is a drive-on watercraft dock for small watercraft, and more commonly, for personal watercraft (PWC) such as a Jet Ski® or Sea Doo® personal watercraft and small boats, such as boats under about 25 feet in length. Drive-on watercraft docks keep the watercraft out of the water when on the dock, making it easier to service the watercraft and board and disembark from the watercraft. Dry docking of watercraft also protects the watercraft from algae, barnacles, etc. which, depending on where the craft is used, can grow on the craft's hull. Several drive-on watercraft docks have been developed. However, they are generally complicated in shape and expensive to manufacture and assemble.

BRIEF SUMMARY OF THE INVENTION

A floating drive-on watercraft dock of the present invention comprises a body having an upper surface, a lower surface, and front, back, and side surfaces extending between the upper and lower surfaces. The upper, lower, front, back and side surfaces define a volume which is preferably air filled, however, it may be filled with a buoyant material. The dock includes a watercraft receiving area formed in the upper surface of the dock. The watercraft receiving area is open at the back surface of the dock and comprises an entrance section extending forwardly from the dock back surface and a main section extending forwardly of the entrance section.

The watercraft receiving area main section includes a bottom surface and sidewalls. Pockets are formed in one, and preferably both, of the watercraft receiving area bottom surface and side walls. The pocket in the bottom surface receives a bottom roller or glide assembly; and the pockets formed in the side walls receive side wall glide assemblies. The watercraft receiving area entrance section includes a sloped ramp, sidewalls extending from the watercraft receiving area entrance section bottom surface to the dock body top surface, and opposed side wall pockets on the entrance section side walls. Side wall glide assemblies are received in each of the side wall pockets of the main and entrance sections to the watercraft receiving area and bottom roller or glide assemblies are received in each of the bottom roller pockets of the watercraft receiving area.

Shoulders border the bottom roller pockets, and transverse grooves are formed in the shoulders. The bottom roller assembly comprises an axle, the opposed ends of which are received in the shoulder grooves, and at least one roller rotatably mounted on the axle. A plate extends over the axle and is secured to the shoulder to maintain the bottom wall roller assembly in place.

The side wall glide assemblies in one embodiment comprise a base member having a plate sized and shaped to be received and held in the side wall roller pocket and a transverse member which extends up from the base. A bracket is selectively positionable horizontally along the transverse member. An axle is pivotally received in a selected vertical position on the bracket, and roller members are received on opposite ends of the axle. The ability to selectively position the bracket along the transverse member and to selectively position the axle on the bracket allows for the side wall roller assembly to be configured for different shaped watercraft and watercraft hulls. In a second embodiment of the glide assembly, the rollers are replaced with a pad which the hull of a watercraft can slide over. A third embodiment of the glide assembly comprises two base members positioned in spaced apart side pockets. A track of rollers extends between and is mounted to the two base members.

The floating watercraft dock includes a plurality of compartments in the dock's bottom surface along the sides of the dock. Inflatable/deflatable bladders can be placed in the compartments. The bladders are operatively connected to a compressor or pump to inflate the bladders when desired.

An extension unit can be connected to the dock to increase the overall length of the dock to allow for the dock to receive longer watercraft. The extension unit comprises an extension body and a tongue extending from a forward surface of the extension body. The tongue has a bottom surface corresponding in shape to at least a back portion of the entrance section of the dock watercraft receiving area, so that the tongue will nest in the entrance section of the dock watercraft receiving area. The extension unit body includes a watercraft receiving area in its upper surface having a ramp, a bottom roller pocket adjacent a top edge of the ramp with a bottom roller assembly mounted in the bottom roller pocket, and side wall pockets formed in opposed side walls of the extension watercraft receiving area with side wall glide assemblies mounted in the side wall pockets.

The side walls of the entrance sections of both the extension unit and the dock body flare outwardly to define an entrance to the watercraft receiving area of the extension unit and the dock body. This flared wall guides watercraft into the watercraft receiving area of the dock.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
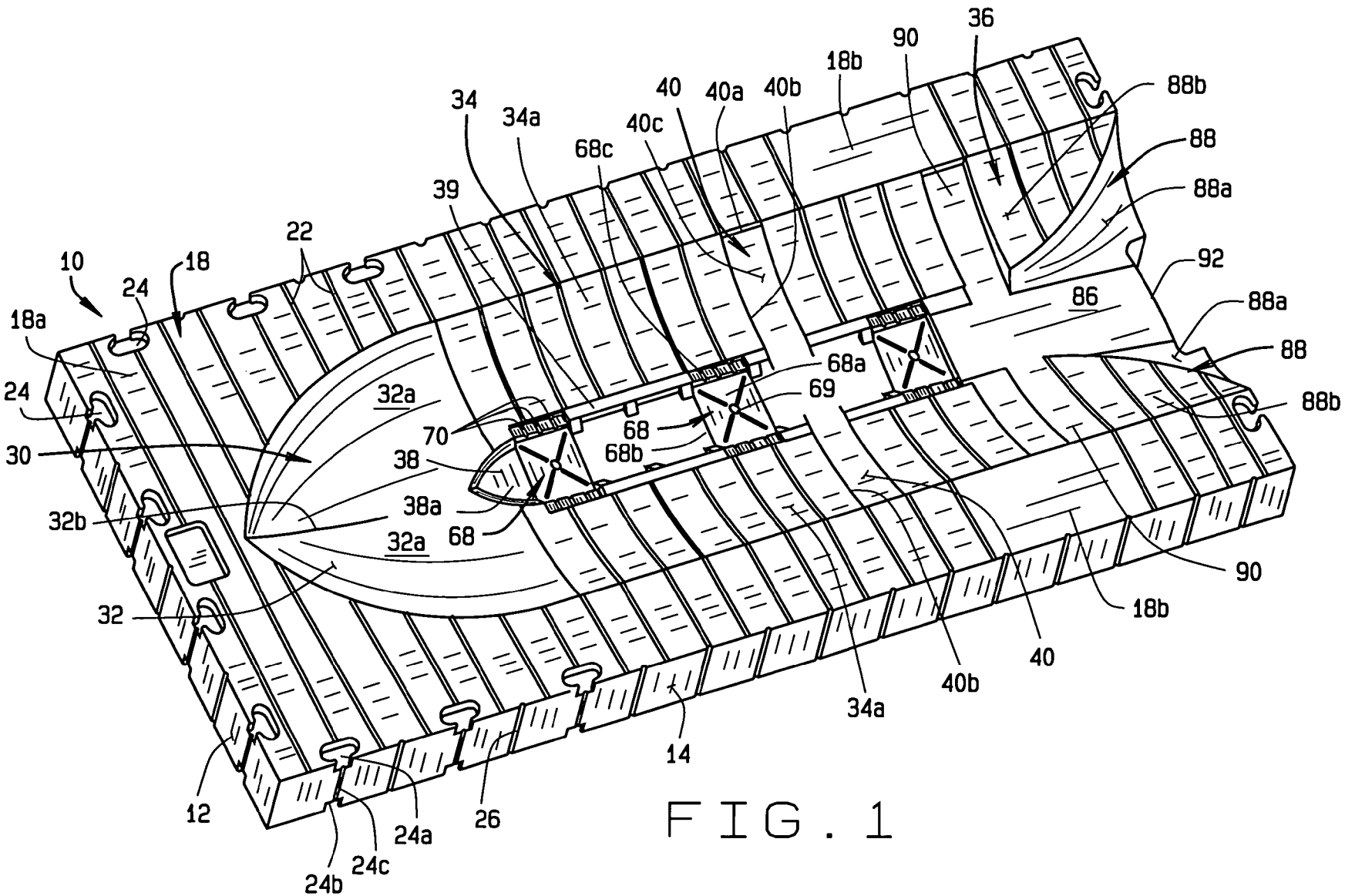
FIG. 1 is a perspective view of a personal watercraft dock of the present invention.

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

An illustrative embodiment of a floating drive-on watercraft dock body or section 10 sized to receive a small watercraft, such as a personal watercraft (PWC) or small boats is shown generally in the figures. To receive personal watercraft, the dock section 10 preferably has the following dimensions: 180" L×80" W×15" D. Although described for use with personal watercraft, the floating dock could be sized to be used with larger watercraft, such as speed boats, which can be twenty feet or more in length, by adding an extension member 130 to the rear of the watercraft dock section 10. To receive a larger (i.e., wider) watercraft, the dimensions of the dock section 10 would be increased appropriately. The dock section 10 and extension member 130 are both formed as a one-piece section molded from a plastic. For example, the dock section 10 and extension member 130 can be formed by rotomolding. Both the dock section and extension member define a volume and are preferably empty (i.e., air filled). However, they may be filled with a buoyant material, such as a foam, if desired.

Figure 3:
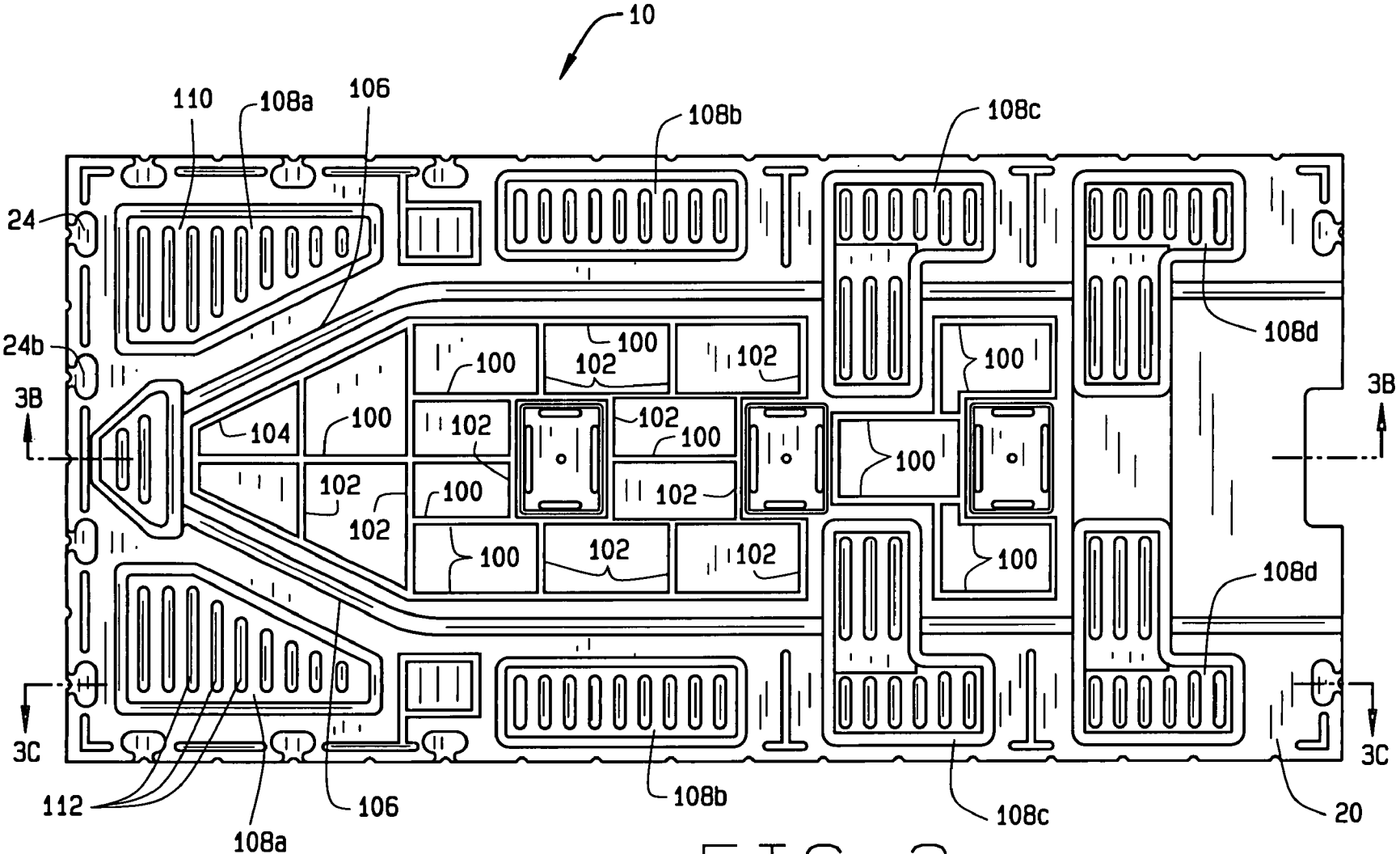
FIG. 3 is a bottom plan view of the dock.

The dock section 10 includes a front 12, sides 14, a back 16, a top surface 18, and a bottom surface 20 (FIG. 3). The top surface 18 of the dock defines a deck surface upon which users walk. Grooves 22 extend across the deck surface 18 to facilitate the flow of water from the deck surface towards the sides. As seen, the grooves 22 extend between opposite sides 14 of the dock section 10, but could also be formed to extend between the front 12 and back 16 of the dock section.

Connector sockets 24 are formed in the sides, front and back of the dock section 10. The sockets 24 include corresponding pockets 24*a* and 24*b* on the deck surface 18 and bottom surface 20 of the dock, respectively. A tie-rod receiving groove 24*c* extends between the two pockets 24*a,b*. The sockets 24 receive a connector 25 (FIGS. 4 and 15), which can connect two dock sections 10 together, or can connect the dock section 10 to a modular dock section. The preferred connector is a "bone" or rounded T-shaped connector, as shown and described in U.S. Pat. No. 5,281,055, which is incorporated herein by reference. The pockets 24*a,b* each correspond in shape to one-half of the connector. As noted in the aforementioned patent, the pockets 24*a,b* of one dock section align with the pockets of a second dock section. The two aligned pockets from the adjacent dock sections define a pocket which is correspondingly shaped to the connector. The connector and pocket 24 are shaped such that the connector cannot be pulled laterally out of the pocket. Hence, a "bone" or rounded T-shaped connector is shown in the above noted patent. However, the connector can take other shapes as well. As can be appreciated, a dock can be formed of several of the drive-on watercraft dock sections 10 connected together, one or more of which can be provided with one or more extensions 130. Alternatively, a dock can comprise a single drive-on dock section 10 which may or may not be connected to a dock section such as described in the above noted patent and which may or may not be provided with an extension.

A series of grooves 26 extend along the sides 14 between the top and bottom surfaces of the dock section 10. When two dock sections are connected together, the grooves 26 of the adjacent and connected dock sections will form openings between the dock sections through which water can pass to facilitate removal of water from the deck surface 18 of the connected dock sections 10.

A watercraft receiving area 30 is formed in the dock top surface 18. The watercraft receiving area 30 is generally centered between the opposite sides 14 of the dock section 10, such that the deck surface 18 forms a bow deck section 18*a* and two side deck sections 18*b*. The watercraft receiving section opens at the back of the dock 10 to receive a watercraft. The watercraft receiving section 30 includes a bow portion 32, a central portion 34, and an aft or entrance portion 36. The three sections, in combination, have a shape which corresponds generally to the shape of a watercraft hull. The bow portion 32 is generally arch-shaped and includes side surfaces 32*a* which curve upwardly from a center line 32*b* toward the sides of the dock section. The bow portion also curves upwardly toward the front of the dock section and the sides surfaces 32*b* also curve inwardly towards the bow of the dock section to meet at an apex. Hence, as seen best in FIGS. 1 and 2, the bow portion 32 of the watercraft receiving area 30 defines a pointed arch (i.e., a gothic style arch).

The center section 34 of the watercraft receiving area 30 has generally parallel sides 34*a* which curve upwardly and outwardly from a central channel 38. The channel 38 has a bow section 38*a* which defines a pointed or apexed arch. A main section 38*b* extends rearwardly from the channel bow section 38*a* to the aft section 36 of the watercraft receiving area 30. The channel main section 38*b* is defined by generally parallel side walls and a bottom surface. A shoulder 39 extends along opposite sides of the channel main section 38*b*. The channel main section slopes downwardly from the bow to the stern or aft of the dock. Hence, the outside wall of the shoulder 39 increases in height from the front of the shoulder towards the rear of the shoulder.

Side pockets 40 are formed on the opposite side walls 34*a* approximately midway along the length of the central portion 34 of the watercraft receiving area 30. The side pockets 40 each have a generally vertical end wall 40*a*, generally vertical side walls 40*b* and a sloped bottom 40*c*. Each side pocket 40 is opened at its bottom opposite the end wall 40*a* to open into the channel main section 38*b*. The sloped bottom 40*c* of the side pocket 40 is generally flat, whereas the watercraft receiving area sides walls 34*a* are curved. Hence, the roller pocket side walls 40*b* vary in height along the length of the walls.

Figure 9:
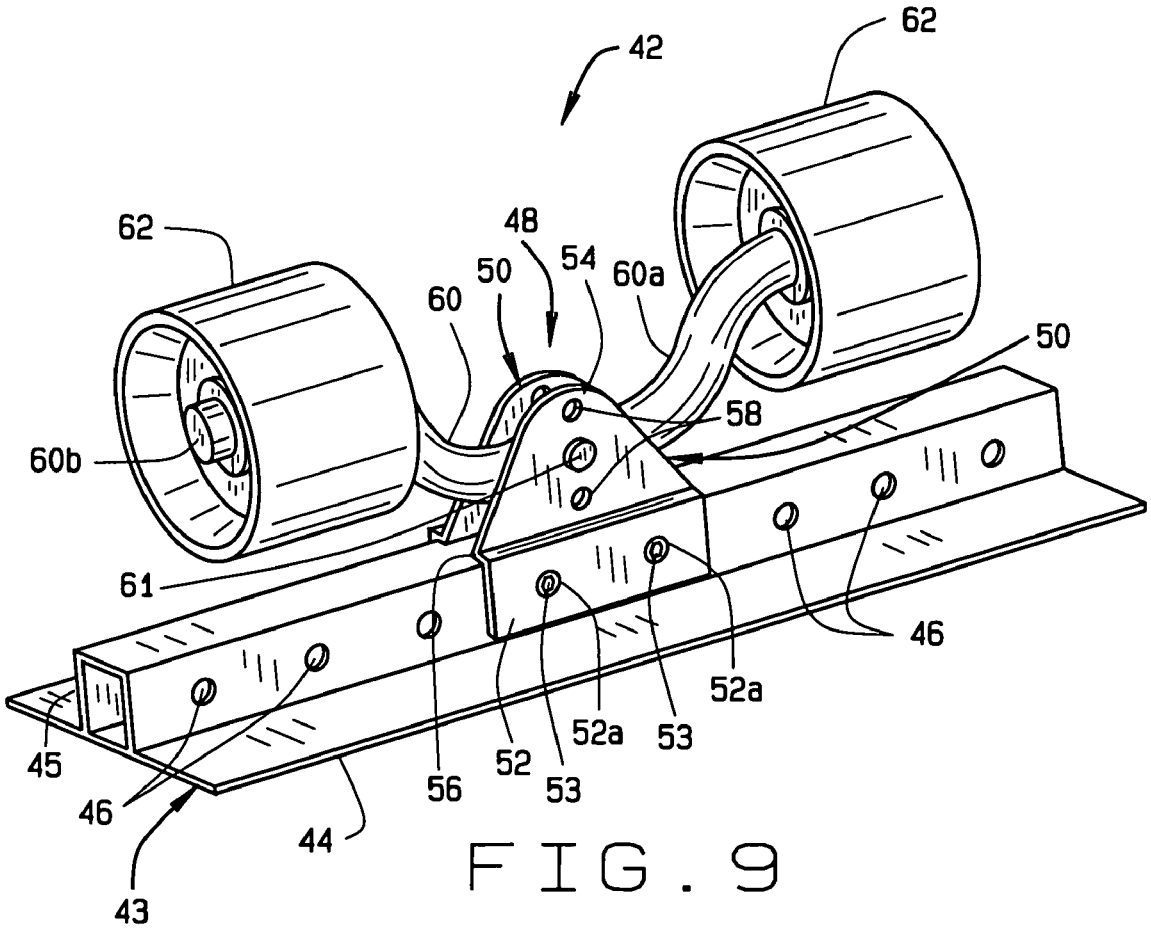
FIG. 9 is a perspective view of an illustrative glide assembly used in the side walls of the dock and extension section.

The side pocket 40 receives a glide assembly 42. The glide assembly 42 (shown in more detail in FIGS. 9–11) includes a base 43 comprising a plate 44 and a channel member 45. The plate 44 is sized and shaped to be received in the side pocket 40. The plate 44 is secured in the side pocket 40 using fasteners, such as screws. The base 43 could be secured in place in the pocket 40 by other means. For example, the pocket 40 could be provided with small ribs or projections to snap fit the base 43 in the pocket. Alternatively, the base could simply be frictionally secured into the pocket. The channel member 45 is positioned approximately mid-way between the elongate sides of the plate 44, giving the base 43 the shape of an inverted T. The channel member 45 has a plurality of openings 46 along its length. The openings 46 are preferably evenly spaced along the length of the channel member 45. The glide assembly base 43 can be formed as a unitary one-piece member with the channel member 45, or the channel member 45 can be a separate piece which is fixed to the plate 44.

In one embodiment of the glide assembly, a bracket 48 is mounted to the channel member 45. The bracket 48 comprises a pair of mirror image members 50 each of which includes a bottom or base section 52 and an upper section 54. The bracket base section 52 includes openings 52*a* which are sized and spaced to be aligned with the spaced openings 46 of the channel member 45. Fasteners 53 pass through the aligned openings of the channel member 45 and the bracket base sections 50 to secure the bracket 48 to the channel member. The bracket upper section 54 extends generally vertically from the base section 52, and is set inwardly slightly from the base section to define a shoulder 56 on the bracket which rests on the channel member 45. Hence, the members 50 are generally "ㄴ"-shaped in side elevation. The two upper sections are generally parallel to each other. A series of openings 58 are spaced vertically along the upper section 54.

An axle 60 is mounted to the bracket 48 between the two bracket members 50 by means of a pin 61 which extends through a selected one of the bracket openings 58 and the axle 60. The pin defines a pivot point about which the axle can rotate. The axle 60 comprises a generally U-shaped central section 60*a* with a pair of arms 60*b* extending outwardly from the opposite ends of the U-shaped central section. The arms 60*b* are co-linear, and receive rollers 62.

Figure 10A:
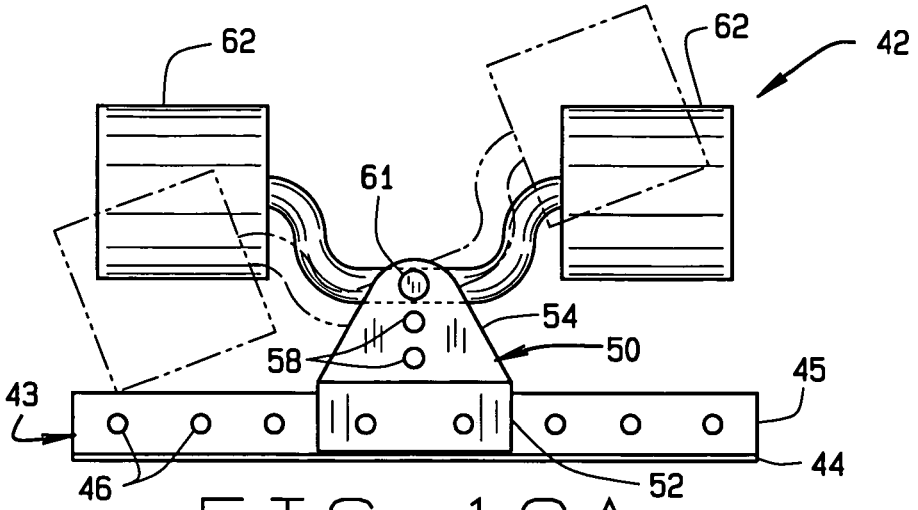
FIGS. 10A and 10B are elevational views of the side wall glide assemblies, demonstrating the rocking of the glide assembly and the ability to adjust the vertical position of the glide assembly.
Figure 10B:
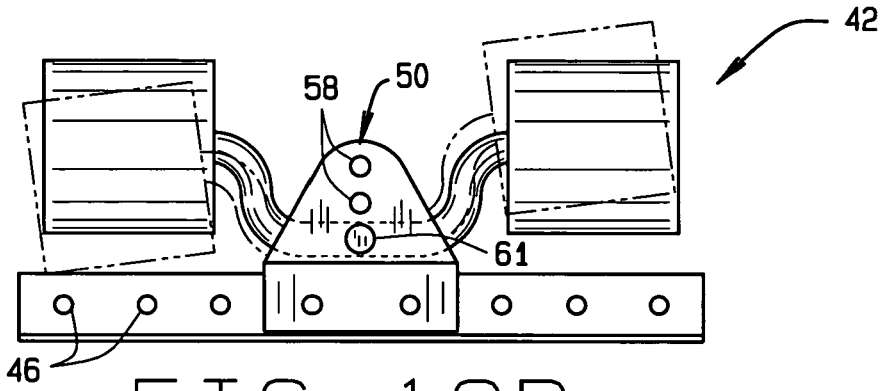
Figure 11:
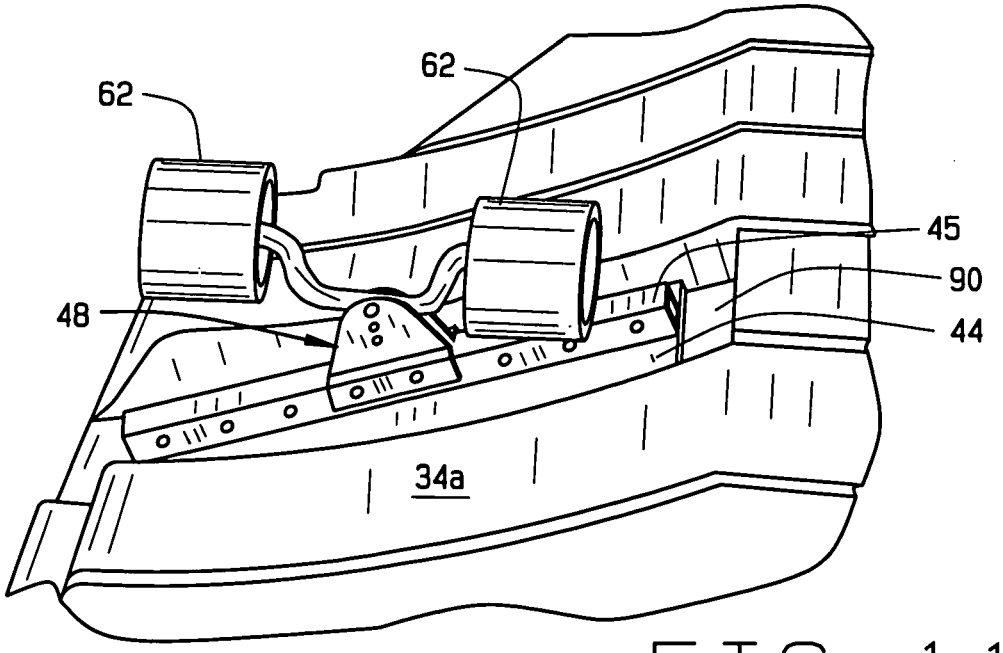
FIG. 11 is an enlarged perspective view of the side glide assembly mounted to the watercraft dock.

As shown in FIGS. 10A and 10B, provision of the bracket openings 58 allows for the vertical position of the axle, and hence the rollers, to be set. Additionally, the provision of the openings 46 on the channel member 45 allows for the horizontal position of the bracket 48 to be set. Hence, the bracket position and roller height can be set (or altered) depending on the shape or size of the watercraft to be received in the watercraft receiving area 30 of the dock 10. As is also shown in FIGS. 10A and 10B, the axles 60 (and hence the rollers 62) pivot around the pivot point defined by the pin. This allows for the rollers to pivot such that both rollers will engage the hull of a watercraft as it is placed on the dock 10. Although fasteners and pins are disclosed to mount the bracket to the channel member and the axle to the bracket, respectively, alternative means can be used to assemble the roller assembly and still retain the ability to selectively position the bracket along the channel member and to selectively position the axle on the bracket. For example, pins could be employed in the channel or bracket which are received in detents or holes in the other of the channel and bracket. Such a pin could even be spring biased. A similar pin arrangement could be employed to connect the axle to the bracket. Alternatively, a groove and rib arrangement could be provided on the bracket and channel to allow said bracket to slide along said channel and to be positioned at any desired position (as opposed to discrete positions) along said bracket.

Figure 12:
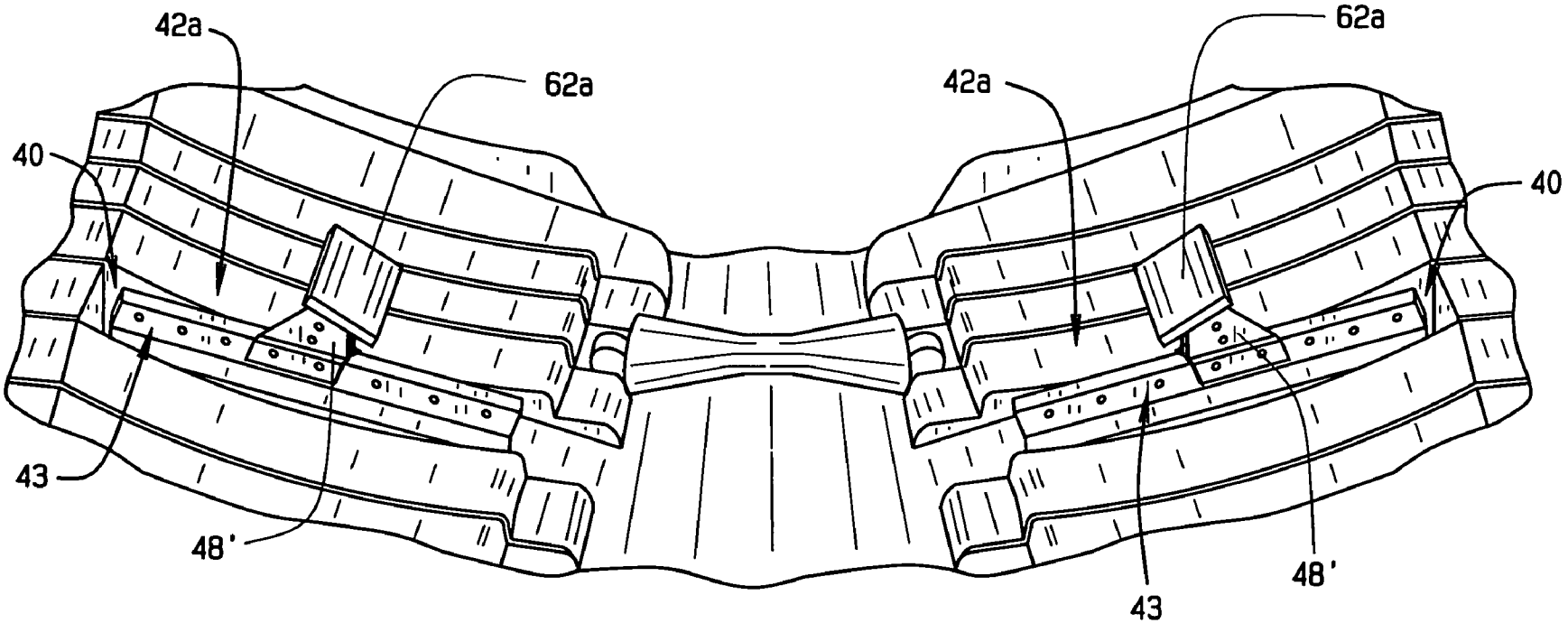
FIG. 12 is a perspective view of an alternative side roller assembly mounted in the watercraft dock.

An alternative glide assembly 42*a* is shown in FIG. 12. The glide assembly 42*a* is shown, in FIG. 12, positioned in side pockets 40 of the dock section 10. The glide assembly 42*a* is substantially similar to the glide assembly 42 (FIG. 9), and includes a base 43 to which a bracket 48' is mounted. However, rather than using rollers, the glide assembly 42*a* is provided with a pad 62*a* which is mounted to the bracket 48'. The pad 62*a* is made from a material, such as polyurethane which will not scratch or mar the watercraft hull and which will allow the watercraft hull to slide fairly easily over the pads 62*a*. Like the roller/axle sub-assembly of the glide assembly 42, the pad 62*a* is mounted to the bracket 48' so that it can pivot or rotate relative to the bracket 48'. As with the rollers 62, this allows for the pad 62*a* to engage the hulls of differently shaped watercraft.

As noted above, the bases 43 of the glide assemblies are received and held in the side pockets 40 by fasteners, such as screws. Over time, the glide member (i.e., the rollers 62 or the pad 62*a*) may need replacing. For example, the rollers 62 may stop rotating readily on the axle arms 60*b*. In this instance, because the glide assemblies are held in place using screws, the glide assemblies 42 and 43 can be easily removed from the side pockets 40 to be replaced with a new roller assembly.

Returning to FIGS. 1 and 2, the channel 38 of the watercraft receiving area 30 also includes spaced apart bottom pockets 68. The pockets 68 have bottom surfaces 68*a*, front walls 68*b*, side walls 68*c*, and back walls 68*d* (FIG. 3B). The bottom surfaces 68*a* are generally level, and are provided with a drain hole 69. Because the channel slopes, as noted above, the front pocket is higher than the middle pocket, and the middle pocket is higher than the aft pocket. The channel surface between the pockets 68 slopes downwardly between the back side 68*d* of one pocket to the front wall 68*b* of the adjacent pocket. Opposed and aligned spaced apart grooves 70 are formed on the channel shoulders 39 between the front and back of the pockets.

Figure 2:
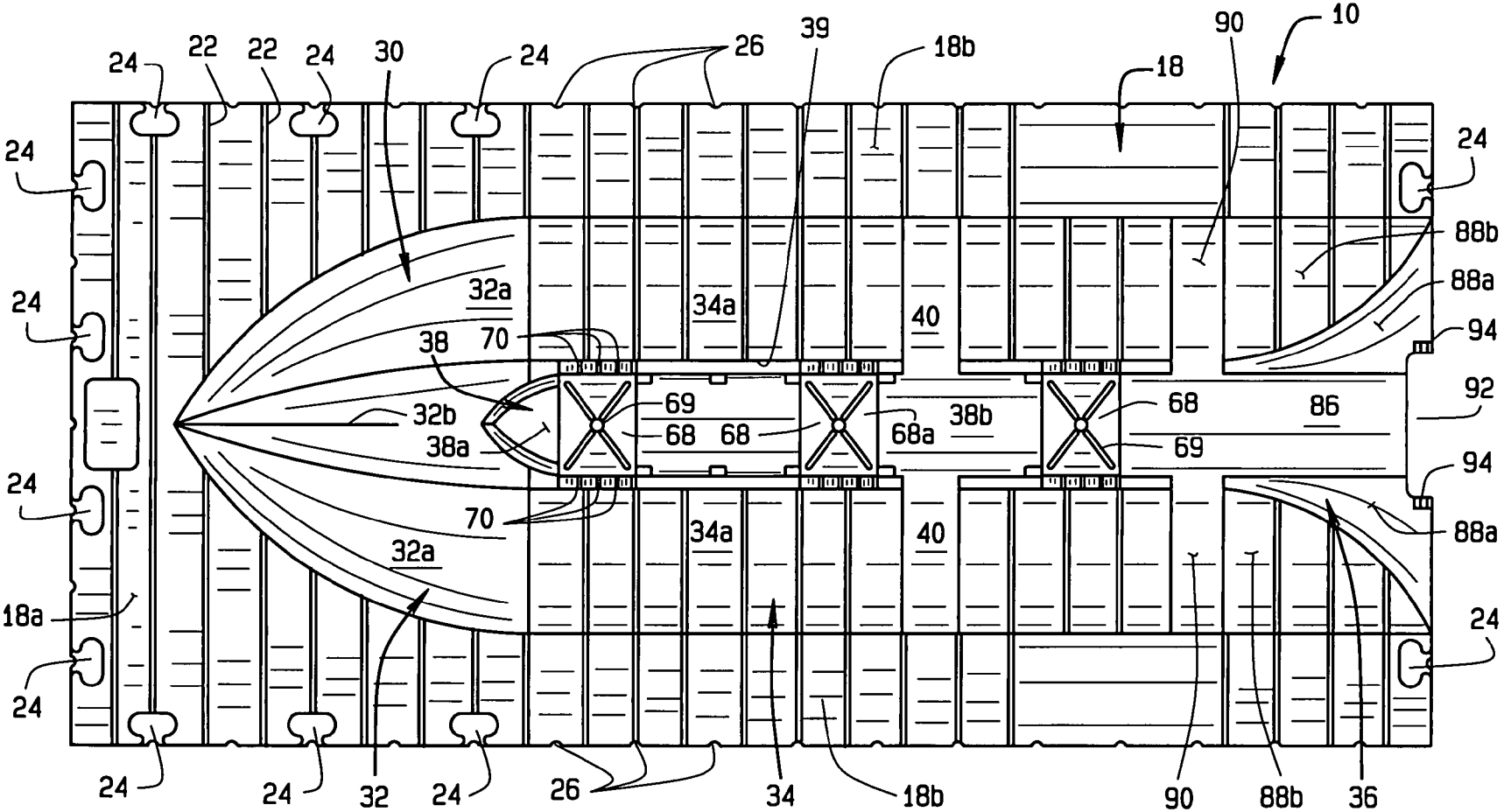
FIG. 2 is a top plan view of the dock.
Figure 2A:
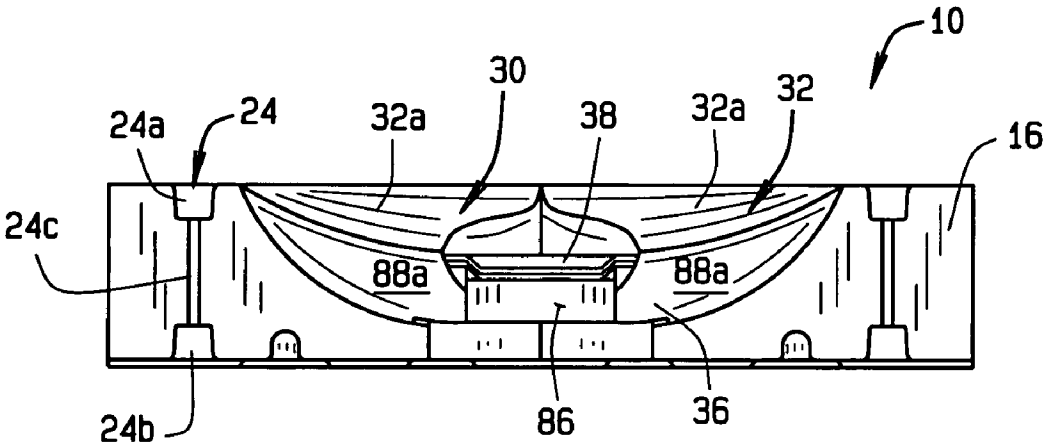
FIG. 2A is a rear elevational view of the dock.
Figure 2B:
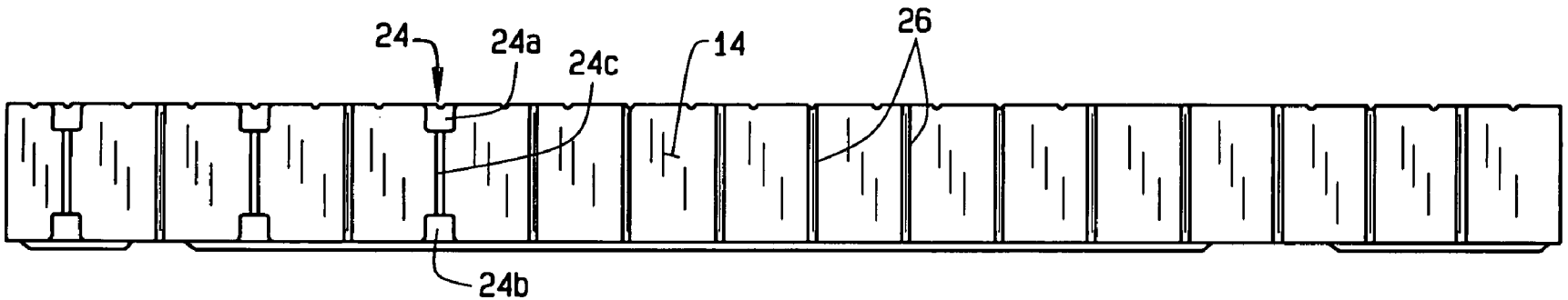
FIG. 2B is a side elevational view of the dock.
Figure 13:
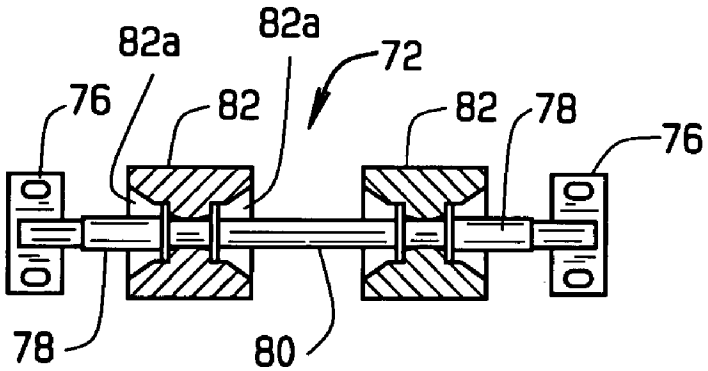
FIG. 13 is a top plan view of a roller assembly used in the bottom of the dock and extension section.
Figure 14:
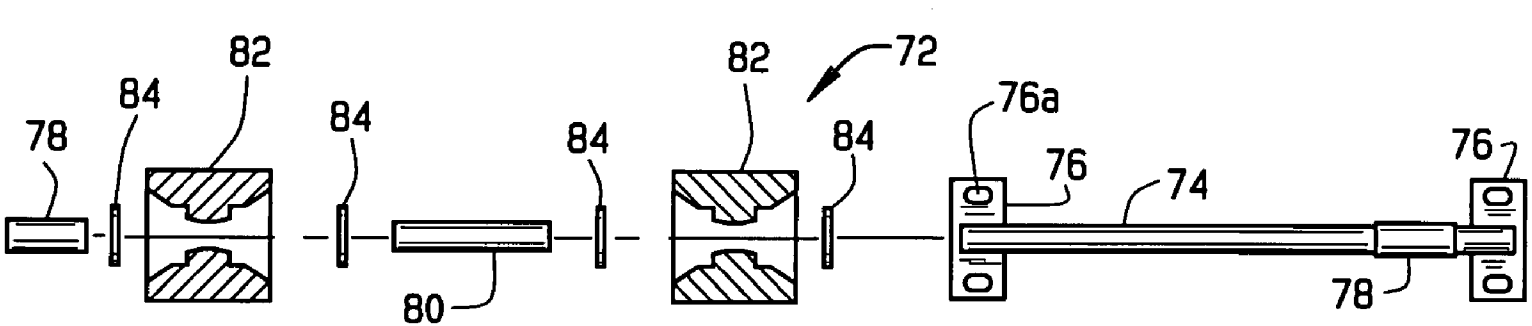
FIG. 14 is an exploded top plan view of the bottom roller assembly.

The channel or bottom pockets 68 receive bottom roller or glide assemblies 72. The roller assemblies 72 (FIGS. 13 and 14) include an axle 74 which is sized to extend between the opposite shoulders 39 and to be received in the shoulder grooves 70. The axle 74 is held in place in the pocket shoulder grooves 70 by plates 76 which extend over the axle and which are secured to the channel shoulder 39 by fasteners. For example, as seen in FIGS. 1 and 2, the shoulder grooves are formed in groups of threes. The axle 74 can be received in the middle of the three grooves, and the plate 76 extends over the axle and has openings 76*a* which align with the outer grooves 70. A fastener can extend through the plate openings 76*a* and through the shoulder grooves 70 thereby securing the axle in place. The axle 74 receives a pair of outer spacers 78 which are generally adjacent the plates 76, a central spacer 80, and a pair of rollers 82 which are positioned between the central spacer and the outer spacers. As seen in FIGS. 13 and 14, the rollers have end openings 82*a* into which the spacers extend. Preferably, washers 84 are provided and are positioned in the roller end opening 82*a* between an inner wall of the roller and the central and outer spacers. To prevent the rollers from moving along the axle 74, the outer spacers 78 are fixed to the axle 74, for example, by welding. As noted, the roller assemblies 72 are held in place by the plates 76. The roller assemblies 72 can be easily removed and replaced if necessary, simply by removing the plates 76. Once the plates 76 are removed, the roller assembly 72 can be easily lifted out of the dock 10 and replaced with a new roller assembly.

Although the bottom roller assembly axle is shown to be received in the shoulder grooves 70, the bottom roller assembly 72 could be held in place by other means. For example, opposite ends of the roller assembly axle 74 could be in brackets which in turn are secured to the dock section 10, either within the pocket 68 or adjacent the pocket 68. Other conventional means to secure the roller assembly 72 in the pocket 68 can be used. Preferably, such means would allow for removal of the roller assembly 72, should the roller assembly need replacement. Alternatively, the shoulder slots or grooves 70 could be shaped to snappingly receive and secure the axles 74 in place.

Turning back to FIGS. 1 and 2, the aft section 36 of the watercraft receiving area 30 includes a sloped ramp 86 which extends rearwardly from the back of the aft channel roller pocket 68. The ramp 86 slopes downwardly to the opened back of the dock section 10. Opposed side surfaces 88 extend upwardly from opposite sides of the ramp 86. The side surfaces 88 include a generally flared lower and rear surface 88*a* and a curved upper and forward surface 88*b*. The curved surface 88*b* is effectively a continuation of the surface 34*a* of the central section 34. The rear surface 88*a* flares outwardly from the ramp to define the back opening into the watercraft receiving area 30. As can be appreciated, because the wall surface 88*a* flares outwardly, the surface 88*a* will guide a watercraft entering the dock section 10 such that the watercraft is properly aligned in the watercraft receiving area 30.

A pair of opposed side pockets 90 are formed in the forward surface 88*b* slightly rearwardly of the front end of the ramp 86. The pockets 90 each receive a glide assembly 42 (or 42*a*). Lastly, a cutout 92 is formed at the back edge of the dock 10, at the back end of the ramp 86 to receive an aft roller. The side walls of the cutout 92 are provided with grooves 94 formed in a shoulder. The grooves 94 receive an axle of an aft roller assembly (seen in FIG. 4). The axle of the aft roller assembly is held in place by a plate, similarly to the channel bottom roller assembly 72.

Figure 3A:
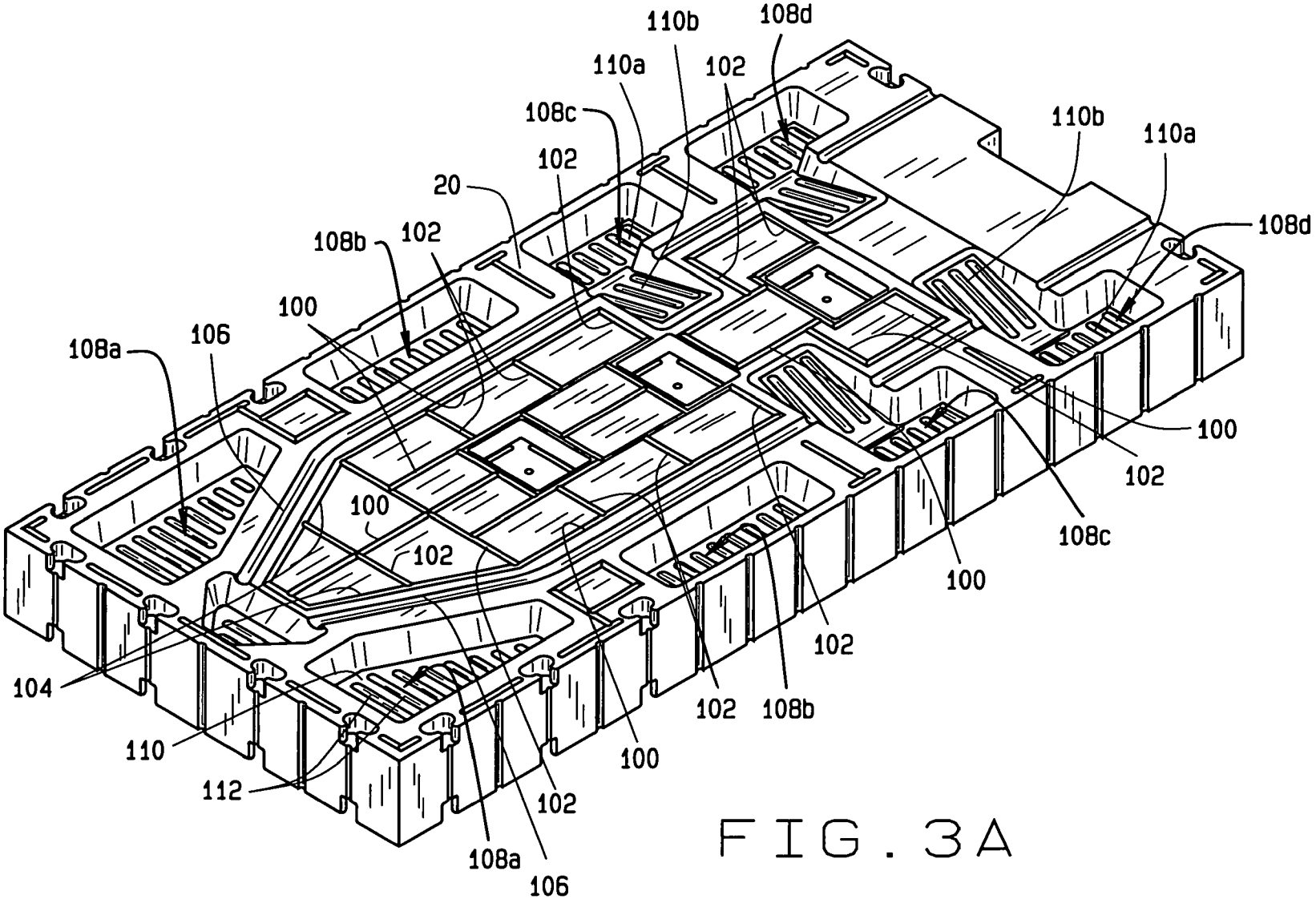
FIG. 3A is a perspective view of the dock bottom
Figure 3B:
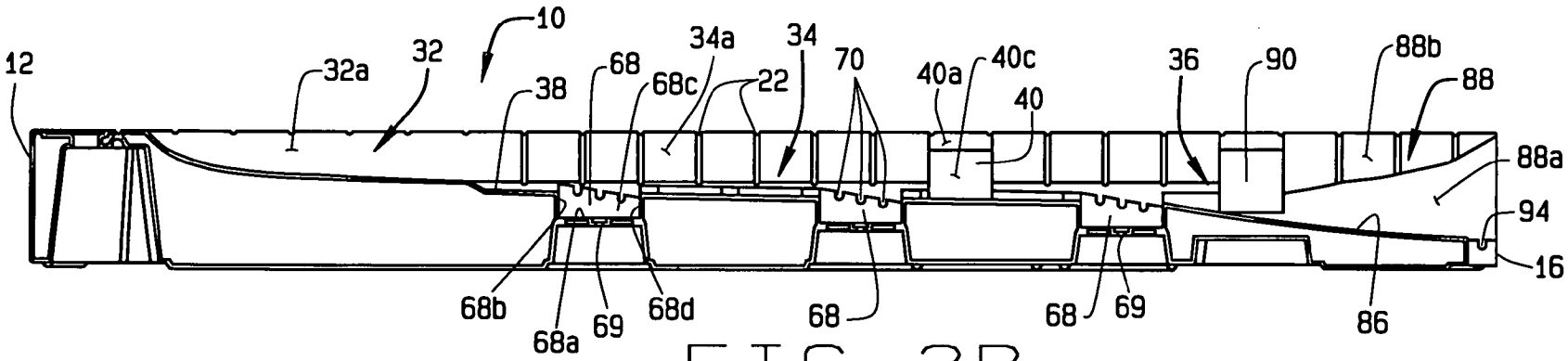
FIG. 3B is a cross-sectional view of the dock taken along line 3B—3B of FIG. 3.
Figure 3C:
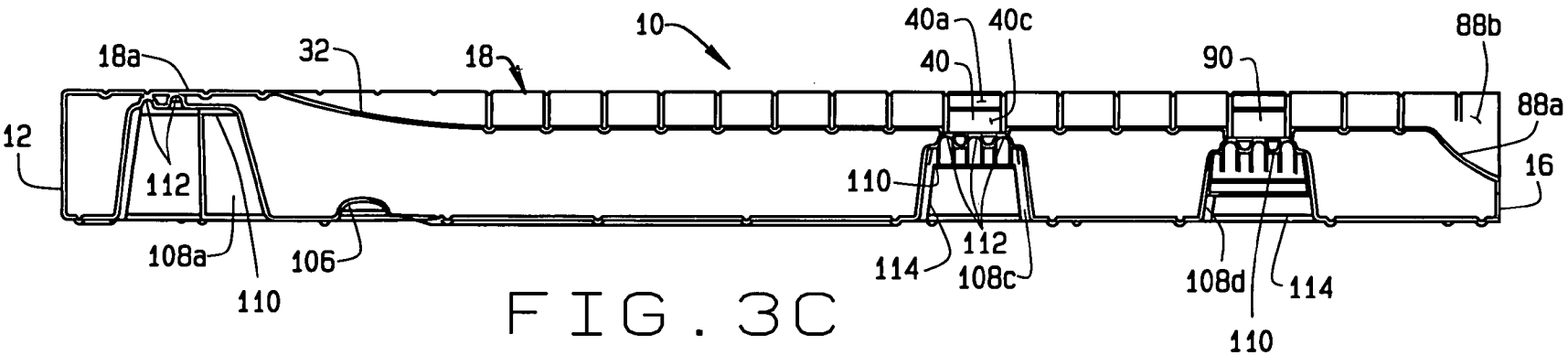
FIG. 3C is a cross-sectional view taken along line 3C—3C of FIG. 3, and including inflatable/deflatable bladders received in pockets in the dock bottom.

Turning to FIGS. 3 and 3A, the bottom 20 of the dock section 10 includes a plurality of channels 100, 102 and 104 beneath the watercraft receiving area 30. The channels 100 and 102 extend perpendicularly to each other, the channels 100 extending axially and the channels 102 extending transversely, to define boxed areas. The channels 104 extend diagonally, rearwardly and outwardly from near the bow of the watercraft receiving area 30. The channels 100, 102, and 104, as can be appreciated, provide structural rigidity to the dock section 10. Additionally, a larger, wider channel 106 extends around the periphery of the watercraft receiving area 30 in the dock bottom 20.

The dock bottom 20 includes several compartments 108*a–d* spaced along the periphery of the dock bottom, and positioned to be generally under the dock section surfaces 18*a* and 18*b*. The forward compartments 108*a* are generally trapezoidal in shape; the forward central compartments 108*b* are generally rectangular in shape; the rear central compartments 108*c* and the rear compartments 108*d* are generally L-shaped. The compartments 108*a–d* are arranged on opposite sides of the dock bottom 20, such that an axis of symmetry with respect to the compartments extends through the center of the dock between the front and rear edges of the dock. The compartments 108*a–d* all have upper surfaces 110 having transversely extending channels 112 formed therein to provide structural rigidity to the pocket surfaces. The upper surfaces 110 of compartments 108*a* and 108*b* are generally level. However, the upper surface of the compartments 108*c* and 108*d* include a level portion 110*a* and a sloped portion 110*b*. The level portion 110*a* extends along the side of the dock section, and the sloped portion 110*b* extends transversely toward the center of the dock section 10 from the inner edge of the surface 110*a*. Thus, the compartments 108*c,d* are deepest adjacent the edge of the dock section 10, and progressively get shallower towards the center of the dock section along the inwardly extending portion of the L-shaped pocket. The top surface of the compartments 108*a–d* is spaced from the underside of the dock deck 18, and the channels 112 have a peak which is adjacent the bottom side the dock deck 18. Preferably, the channels contact, or are spaced only slightly from, the bottom side of the dock deck 18. Preferably, the channels 112 are attached to the underside of the dock deck 18. In contacting (and being attached to) the bottom side of the dock deck 18, the channels 112 provide support for the dock deck.

Figure 3D:
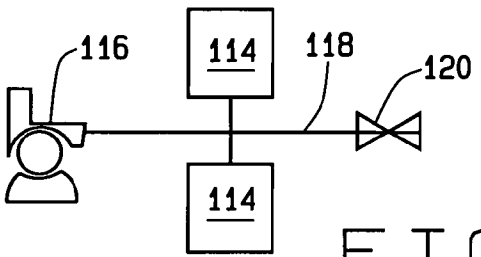
FIG. 3D is a schematic drawing shown the connection of the bladders to a compressor.

Watercraft are generally back heavy. Thus, when the watercraft is docked on the dock, the dock will slope rearwardly. That is, the back of the dock will be lower than the front of the dock. To raise the back of the dock, so that the dock will be level when a watercraft is positioned on the dock, inflatable/deflatable bladders 114 can be positioned in the rear two compartments 108*c* and 108*d*. When inflated, the bladders will increase the buoyancy of the back of the dock section 10, thereby raising the back of the dock, so that the dock will be level. The bladders 114 are operatively connected to a compressor/air pump 116 over air tubes 118, as seen schematically in FIG. 3D. A valve 120 is placed in the line 118. To inflate the bladders, the valve 120 is closed, and the compressor is operated. The bladders are connected to the compressor/pump in parallel, and hence, will inflate at substantially the same rate. Once inflated, the compressor is turned off. To deflate the bladders, the valve 120 is opened to place the air tube, and hence the bladders 114, in communication with the atmosphere. When the valve is opened, the weight of the dock will compress the bladders, causing the bladders to deflate. Again, because the bladders 114 are connected to the air line in parallel, the bladders will deflate at substantially the same rate. The compressor 116 can be provided with electricity either through solar panels, a 12V power supply (i.e., from batteries), or from a 110V power supply (i.e., from an electrical a/c outlet).

The compressor 116 can be provided with an automatic shut-off, such that the compressor will shut off when a predetermined pressure within the bladders 114 is reached or when the dock section is level. For example, a mercury switch or the like can be used to open the circuit when the dock 10 is level.

Although the bladders 114 are provided only in the rear two compartments 108*c* and 108*d*, inflatable/deflatable bladders could also be provided in the forward compartments 108*a* and 108*b*. Such additional bladders would also be connected to the air line 118 to be inflated by the compressor 116. The provision of air bladders in the front two compartments 108*a–b* would allow for the complete dock to be elevated to further ensure that a watercraft is out of the water when it is secured in the drive-on watercraft dock. Due to the fact that watercraft are generally back heavy, if bladders are provided in all the compartments 108*a–d*, the rear bladders could be larger than the front bladders to provide for increased buoyancy at the back of the dock to compensate for the increased weight in the back of the watercraft. Alternatively, a second valve could be provided for the bladders in the front pocket. Such a valve could be manually or automatically operated to maintain the dock level during inflation and deflation of the air bladders.

Figure 4:
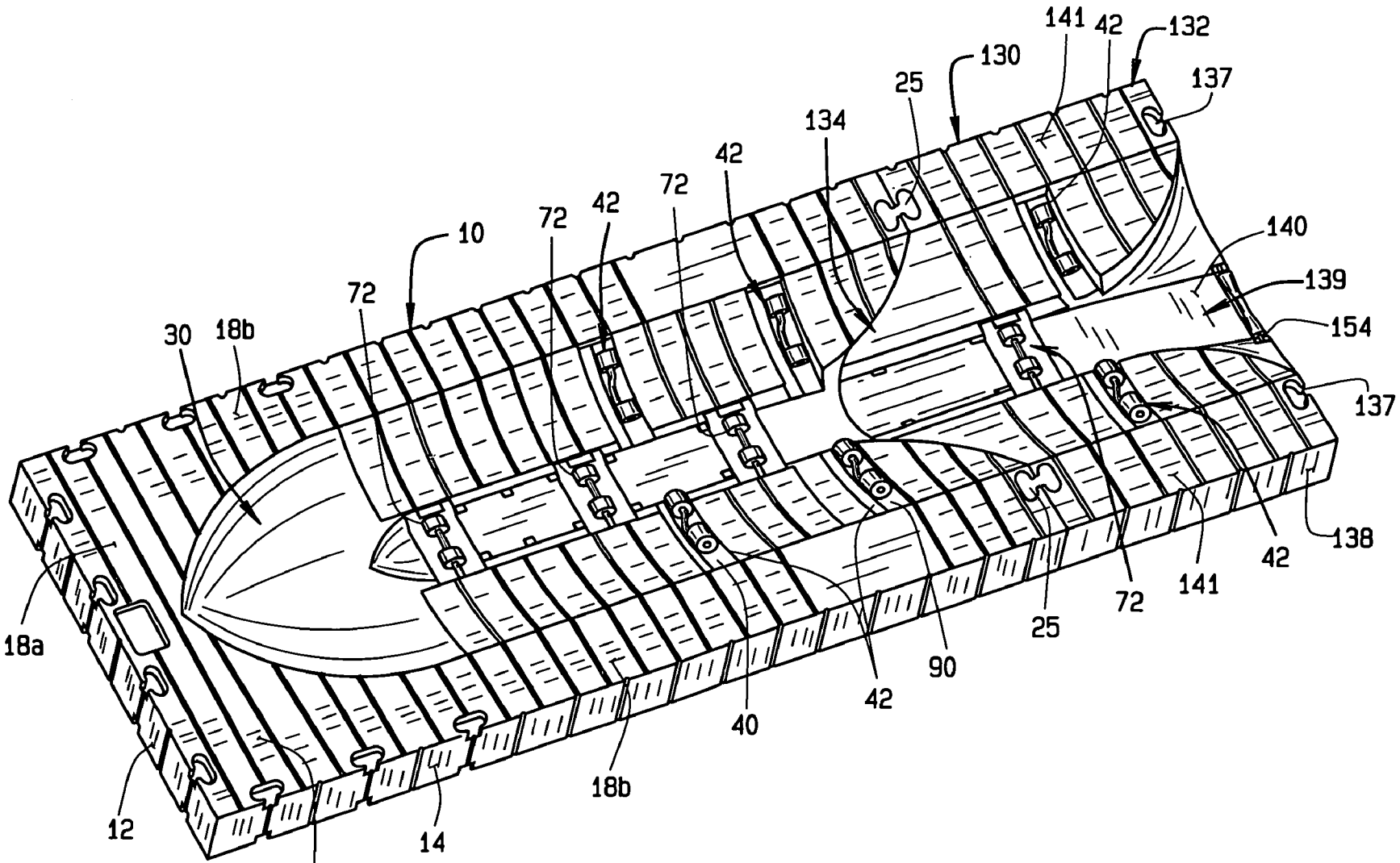
FIG. 4 is a perspective view of the dock with an extension section attached thereto and with glide assemblies in the form of roller assemblies placed in both the dock and the extension section.
Figure 5:
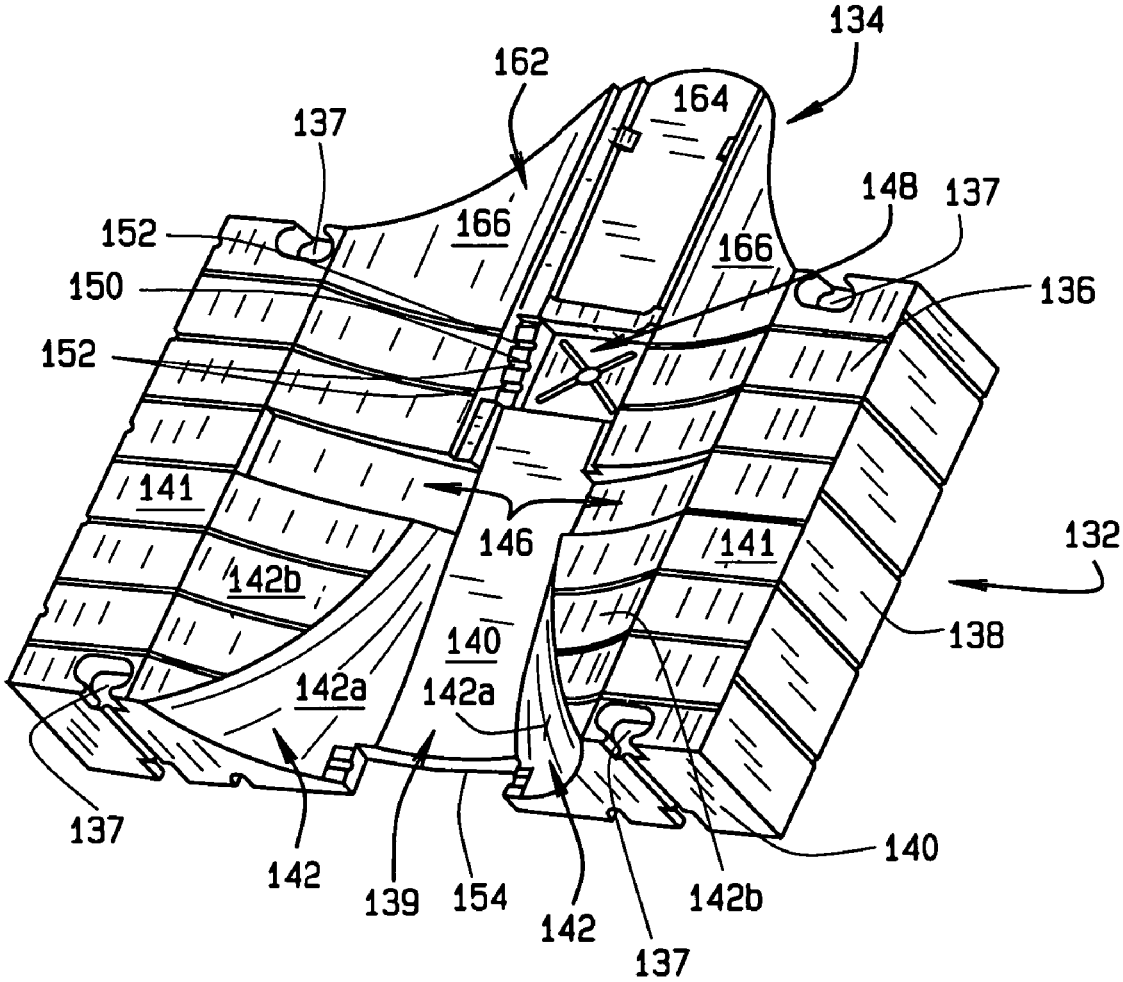
FIG. 5 is a perspective view of the extension section.
Figure 5A:
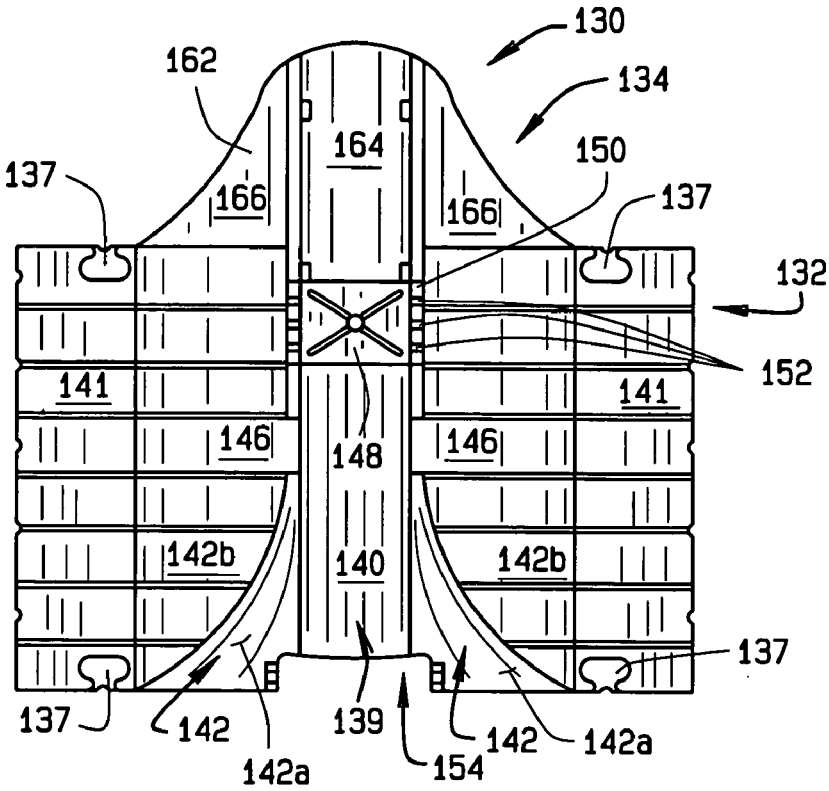
FIG. 5A is a top plan view of the extension section.

As shown in FIG. 4, an extension 130 can be added to the dock section 10, to provide for a longer dock. The dock section 10, with the dimensions noted above, can receive a watercraft of up to 14' in length. The extension 130 is sized to give the dock an overall length of about 19' (about 5.8 m), which will allow for the dock to receive watercraft of up to 18' (about 5.5 m) in length. Additional extensions 130 can be added to provide a dock which will receive even longer watercraft.

As seen more clearly, in FIGS. 5–8, the extension 130 includes a body portion 132 and a tongue 134 extending forwardly from the body. The extension body 132 has a top surface 136, side walls 138, a back surface 140, a front surface 142, and a bottom surface 144. Like the dock section 10, the dock extension 130 is preferably hollow and empty. Although, the extension can be filled with buoyant material if desired. The extension body has a width and height substantially equal to the width and height of the dock section 10, such that when the extension 130 is connected to the dock section (as explained below), the extension top surface will be co-planar with the dock section top surface 18, the extension side surfaces will be co-planar with the dock section side surfaces 14, and the extension bottom surface 144 will be coplanar with the dock section bottom surface 20. As seen in FIG. 4, this gives the extended dock a uniform appearance.

The extension body 130 defines a watercraft receiving area 139 substantially similar to the aft section 36 of the watercraft receiving area 30 of the dock section 10. The watercraft receiving area 139 is bordered on its opposite sides by deck surface 141 which has a width substantially the same as the side deck surface 18*b* of the dock section 10. Connector sockets 137 are formed at the front and back of the extension body 132. The connector sockets 137 are identical to the connector sockets 24 of the dock section 10. The forward sockets are positioned to be aligned with the sockets 24 at the rear of the dock section 10, as seen in FIG. 4. Connectors or couplers 25, as described in U.S. Pat. No. 5,281,055 are then received in the aligned sockets 24, 137 to secure the extension 130 to the dock section 10. The extension body is provided with grooves or channels along its deck and side surfaces, similarly to the dock section 10 to facilitate the removal of water from the upper surface 136 of the extension 130.

As described in the just noted patent, the bone shaped couplers 25 are comprised of upper and lower anchors which are received in the upper and lower pockets of the connector sockets and a tie rod which extends between the anchors and is received in the channel extending between the upper and lower pockets. The coupler can be constructed of any suitable material, but preferably, is made of rubber. The rubber construction results in an anchor that can be positioned tightly into the sockets with sufficient strength to withstand the torsional stresses exerted upon it when in the socket by the actions of the waves and wind, yet is also flexible enough to be compressed by these forces without losing much of its strength or resiliency. The connection between the connector tie rod and the connector anchors allows for tightening of the connection. During assembly of a dock, after the connector anchors have been placed within the connector sockets, the tie rod is tightened to produce a snug fit between the two anchors of the connector. Hence, the connectors will maintain the extension 130 substantially adjacent the dock section 10 such that there will not be a substantial gap between the deck surface of the dock section 10 and the deck surface of the extension 130. The holding of the extension in close proximity to the dock section 10 coupled with the height of the dock section 10 and extension 130 will substantially prevent the extension 130 from moving relative to the dock section 10. That is, the connection between the extension 130 and the dock section 10 is a substantially rigid connection.

Figure 8:
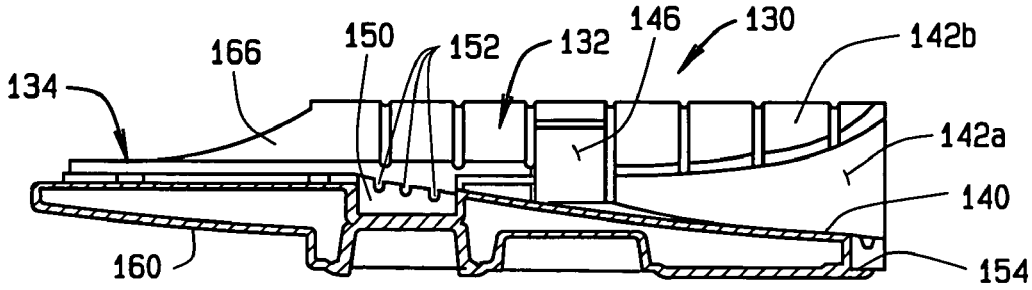
FIG. 8 is a cross-sectional view of the extension section taken along line 8—8 of FIG. 6, the rollers being omitted for purposes of clarity.

The watercraft receiving area 139 of the extension 130 includes a ramp 140 extending generally along the center of the extension 130. Side walls 142 extend up from the sides of the ramp. The sidewalls 142 are substantially similar to the side walls 88 of the watercraft receiving section of the dock section 10. The extension watercraft receiving section side walls 142 include a generally flared lower and rear surface 142*a* and a curved upper and forward surface 142*b*. The rear surface 142*a* flares outwardly from the ramp 140 to define the back opening into the watercraft receiving area 139. A pair of opposed side pockets 146 are formed in the forward surface 142*b* approximately mid-way along the length of the extension. The pockets 146 each receive a side wall glide assembly 42 (or 42*a*). A forward roller pocket 148 is formed at the top of the ramp 140. A shoulder 150 is formed on either side of the pocket 148 and includes grooves 152 (FIG. 8). The shoulder grooves 152 receive an axle of a roller assembly 72, the rollers of which are received in the pocket 148. Lastly, a cutout 154 is formed at the back end of the ramp 140 to receive an aft roller assembly. The aft roller assembly (which is identical to the aft roller assembly placed at the back of the dock) includes a pair of tapered rollers which are journaled about an axle. The axle is received in grooves formed on opposing shoulders on opposite sides of the cutout 154. The axle, and hence the aft roller assembly, is held in place with a plate that is secured to the aft cutout shoulder.

The extension tongue 134 extends forwardly from the forward surface 142 of the extension body 132. The tongue has a length such that the forward end of the tongue reaches to be even with, or slightly rearwardly of the aft section wall roller pockets 90 when the extension is connected to the dock section 10. The tongue has a lower surface 160 that is curved both transversely and lengthwise to form a surface that is complimentary to the walls 88*a* of the watercraft receiving area aft section 36 of the dock section 10. The upper surface 162 of the tongue includes a flat central channel section 164 and curved side walls 166. The channel section 164 is sized, shaped, and positioned to be aligned with the dock section ramp 86. The curved side walls 166 are shaped to correspond to the shape of the aft section walls 88*b*.

Figure 6:
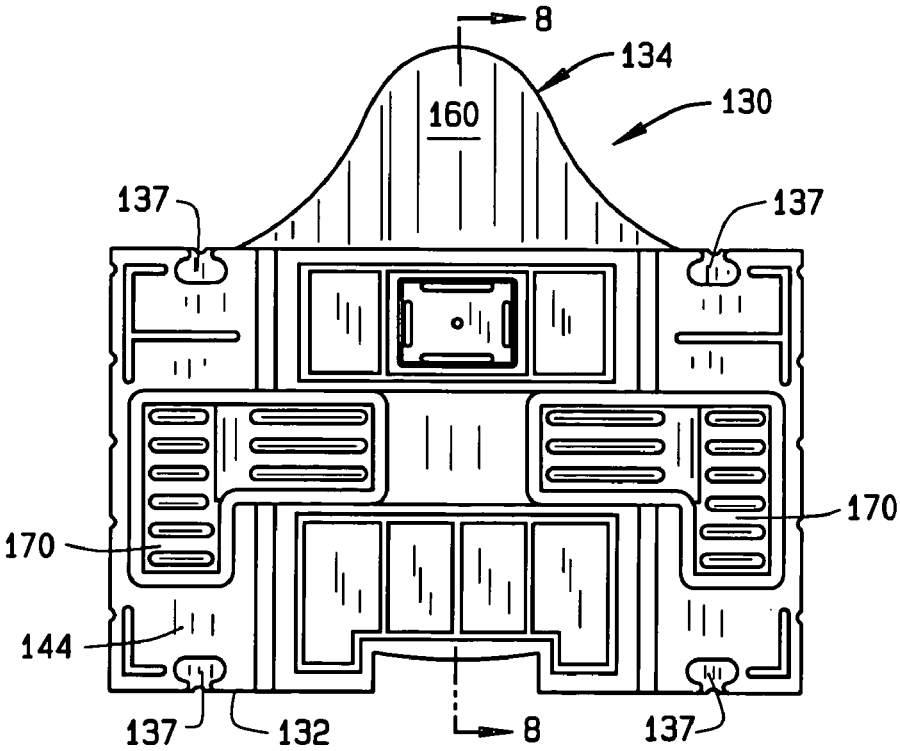
FIG. 6 is a bottom plan view of the extension section.
Figure 7:
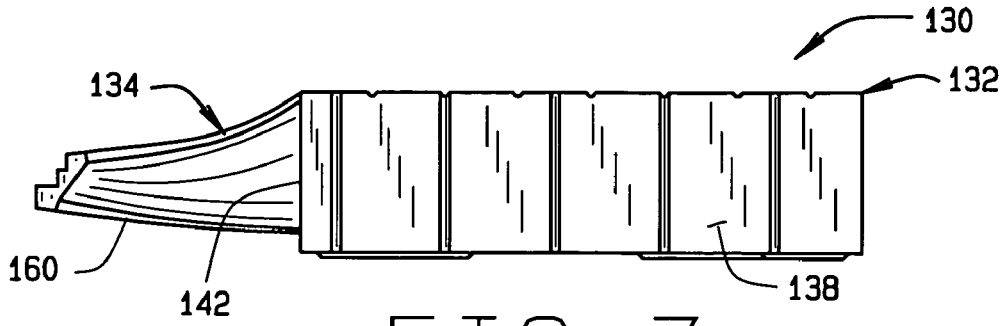
FIG. 7 is a side elevational view of the extension section.

Turning to FIG. 6, the bottom of the extension is generally similar to the bottom of the dock section 10, and includes a pair of opposed bladder compartments 170 positioned beneath the extension deck surface to receive an inflatable/deflatable bladder. Bladder compartments 170 are substantially similar in size and shape to the compartments 108*c,d* of the dock section 10. The bladder of the extension would be connected to the pneumatic system of the dock section 10, to be inflated by the same compressor, and deflated by the same valve.

As best seen in FIG. 4, when the extension is connected to the dock, it forms a continuation of the watercraft receiving area 30 and the deck surfaces 18*b* of the dock section 10. Additionally, because the tongue 134 is shaped to correspond to the dock aft section 36, and the extension watercraft receiving section 139 is substantially identical to the dock aft section 36, a second extension could be added to the first extension, to increase the length of the overall dock even more.

Figure 15:
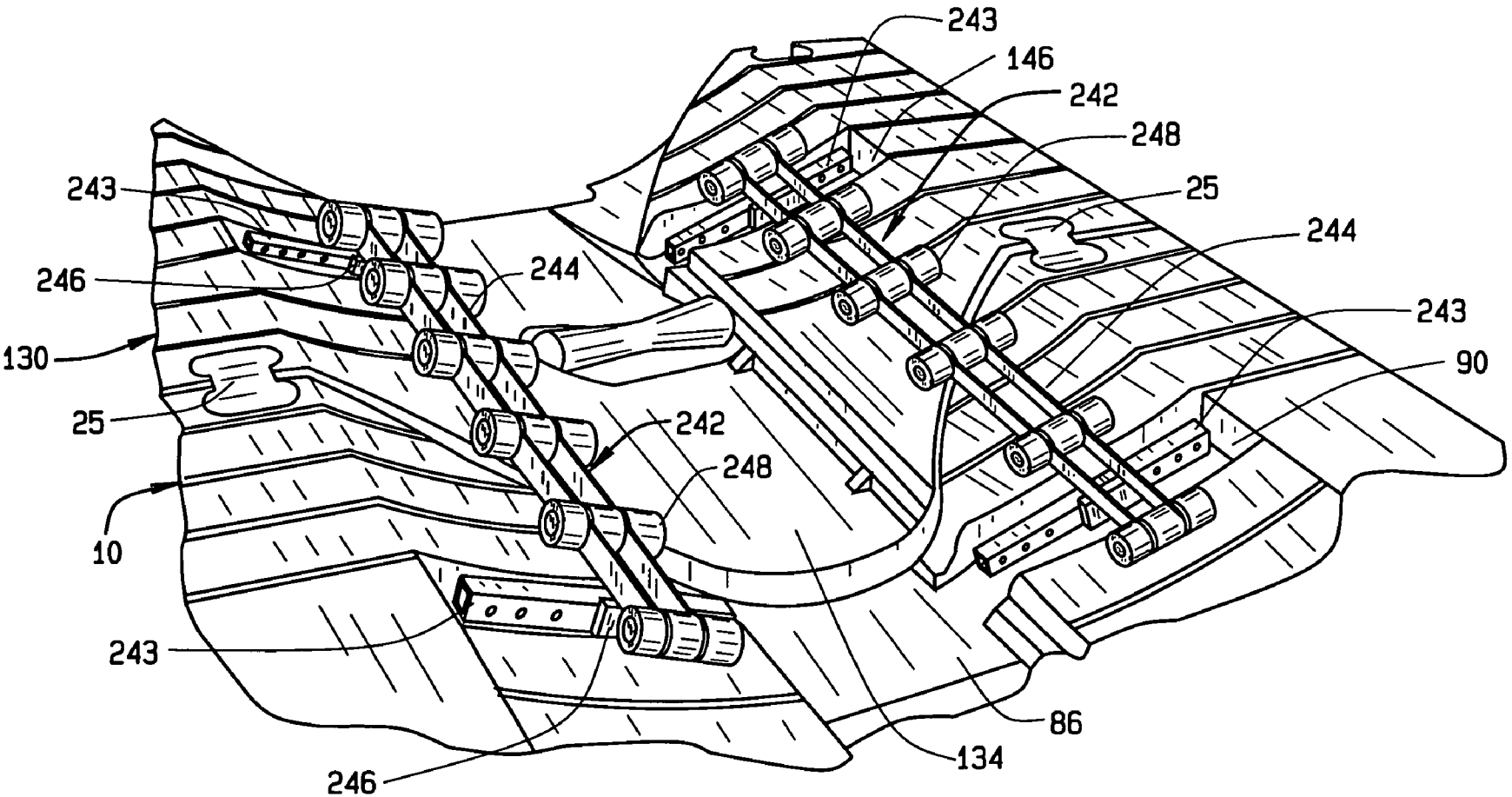
FIG. 15 is a perspective view of another alternative side glide assembly used in a watercraft dock having an extension member connected to the watercraft dock body.

Turning to FIG. 15, when the extension 130 is added to the dock section 10, the combined dock can provided with a glide assembly 242 which spans or extends between the side wall pocket 146 of the extension and the side wall pocket 90 of the dock section 10. The glide assembly 242 comprises a pair of base members 243 which are identical to the base members 43. One of the base members is secured in the extension side pocket 146 and the other is secured in the dock section rear side pocket 90. An elongate rail 244 extends between, and is mounted to the base members 243 via brackets 246. As seen in FIG. 15, the rail extends rearwardly of the aft base member 243 and forwardly of the forward base member 243. The brackets 246, could, like the brackets 48 of glide assembly 42, allow for the rail 244 to pivot relative to the brackets 246. A plurality of rollers 248 are mounted to the rails 244 spaced apart from each other. The rails 244 shown in FIG. 15 are generally U-shaped, and the rollers 248 are provided in groups of three; there is one roller on either side of the rail and one roller in the center channel of the rail. The rail could be provided as a beam, in which case, the rollers would be provided in groups of two—one roller on either side of the beam. Of course, depending on the size and weight of the watercraft that is to pass over the rollers, the rollers could be individual rollers, or provided in groups of four or more. If desired, the rollers could be provided with a plurality of individual pads, or a single elongate pad which extends the length of the rail. Because the glide assembly 242 is an elongate glide assembly, a glide assembly need not be provided in the forward side wall pocket of the dock section 10. Although the glide assembly 242 is shown used on an extended dock (i.e., an assembly of a dock section 10 and an extension member 130), the glide assembly 242 could be used in the dock section 10 by itself. In this case, the glide assembly base members 243 would be received in the side pockets 40 and 90 of the dock section 10.

Figure 16:
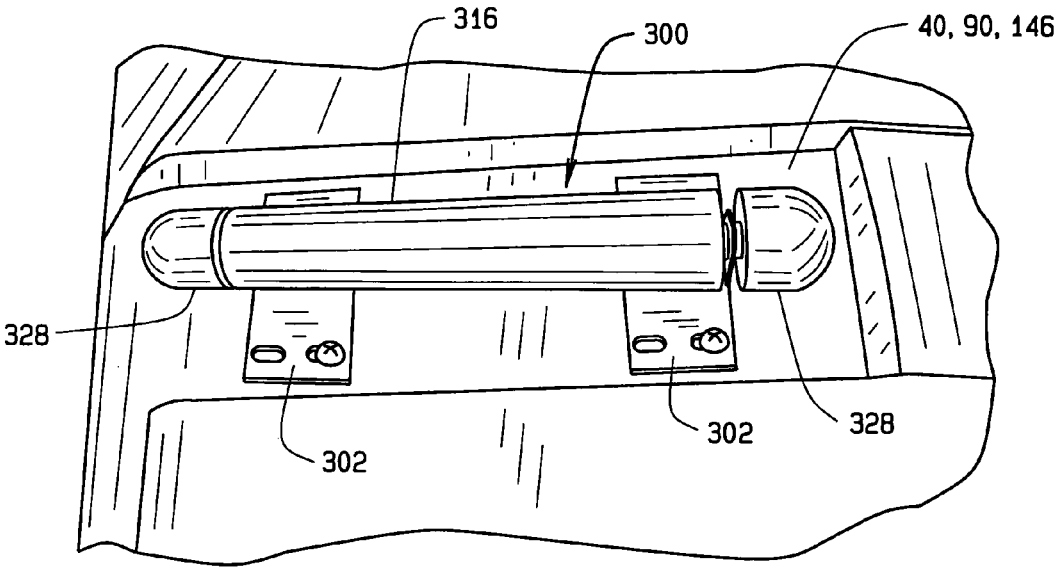
FIG. 16 is a perspective view of a second alternative side glide assembly shown mounted in a side wall pocket of the dock.
Figure 19:
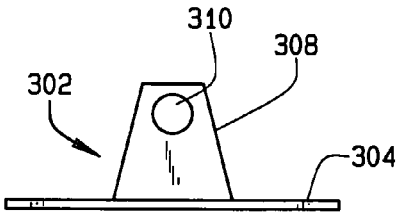
FIG. 19 is an end elevational view of a bracket for the glide assembly of FIG. 16.
Figure 20:
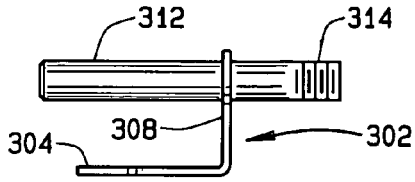
FIG. 20 is a side elevational view of the bracket of the glide assembly of FIG. 16 with a shaft received therein.
Figure 17:
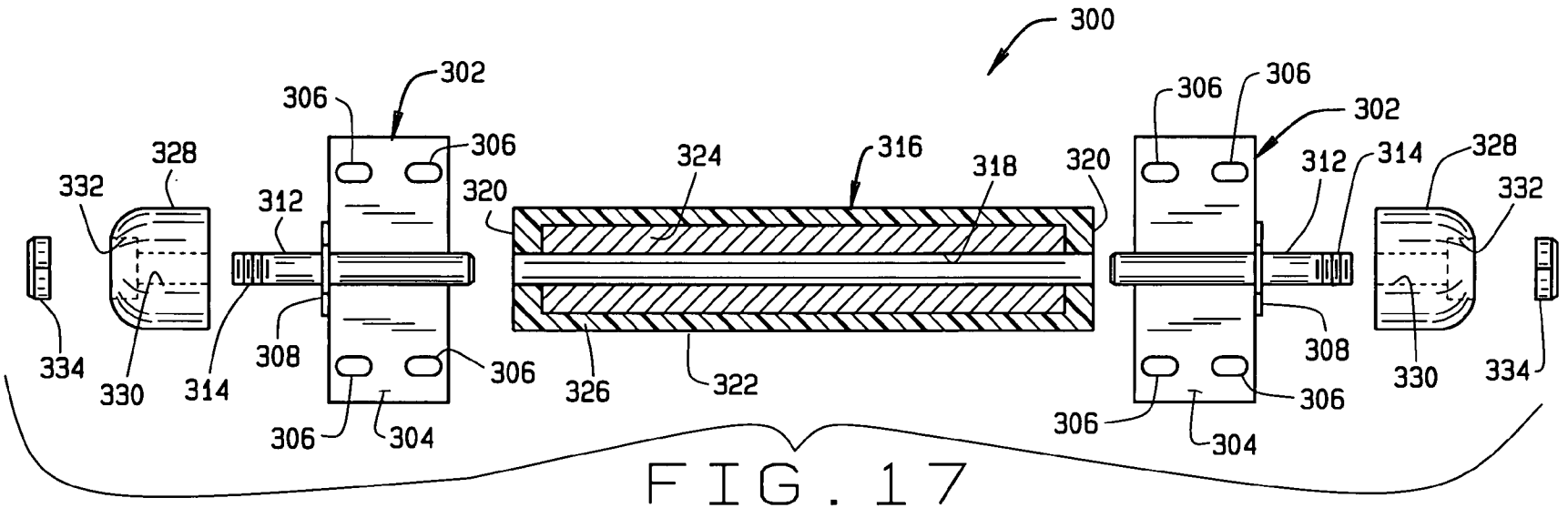
FIG. 17 is an exploded top plan view, partly in cross-section of the side glide assembly of FIG. 16.

A third side glide assembly 300 is shown mounted in a side pocket of the dock. The glide assembly 300 can be positioned in either of the side pockets 40 or 90 of the dock section 10 or in the side pocket 146 of the extension 130. The glide assembly 300 comprises a pair of brackets 302 which are secured to the floor of the pocket as seen in FIG. 16 using fasteners, such as screws, bolts or the like. The brackets can be secured to the base in numerous other ways as well. For example, the pockets can be adapted such that the brackets can be snap fit into the pockets, as described above. As seen in FIGS. 19 and 20, the brackets 302 each include a base 304 having elongate slots 306 formed therein through which fasteners can extend to secure the brackets to the pocket floor. A leg 308 extends generally perpendicularly upwardly from an outer edge of the pocket. The leg is shown in FIG. 19 to be generally trapezoidal in shape, but could be formed in any desired shape. An opening 310 is formed in the leg 308 through which an axle 312 passes. The axle is threaded at its outer end, as at 314. The opening 310 in the bracket leg 308 is sized to allow the axle 312 to rotate freely in the opening.

A central roller 316 is positioned between the bracket legs 308. The roller includes opposite ends 320, an outer cylindrical surface 322, and a passage 318 between the opposed ends 320. Although the passage 318 is shown to extend all the way through the roller 316, the roller could be provided with opposed aligned passages or bores which extend axially inwardly from each end of the roller. As shown, the central roller 316 includes a central metal or rigid core 324 which is surrounded by a softer material 326 (such as a plastic or polyurethane, or other material which will not mar a boat hull as the boat hull passes over the roller). The rigid core provides structural rigidity to the roller 316 and the outer material 326 provides for a surface which will not scratch or mar the boat hull. The core 324 could be omitted from the roller 316, and the roller 316 instead would be formed completely from the outer material, which as noted, can be a plastic, polyurethane, or other material which will not mar a boat hull as the boat hull passes over the roller.

Figure 18:
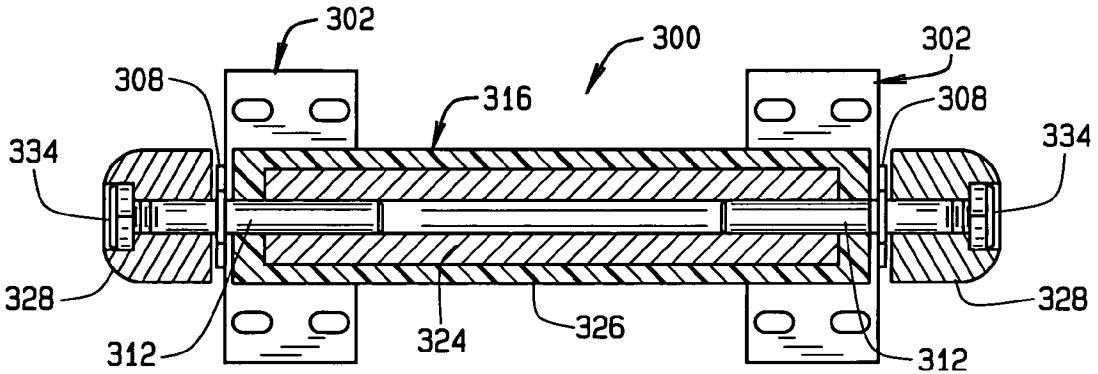
FIG. 18 is a cross-sectional view of the glide assembly of FIG. 16 when assembled.

The passage 318 is sized to frictionally receive the axle 312. As seen in FIG. 18, the axles 312 are sized to extend through the outer layer of material 326 in to the rigid core 324 of the roller. The axles 312 are also sized such that, when received in the opposite ends of the roller, they extend from the ends of the roller 316 and through the bracket legs 308 such that the threaded end 314 of the axle 312 is on a side of the leg opposite of the roller 316.

A roller cap 328 is received on the end of each axle 312. The roller cap 328 is generally cylindrical, having a diameter substantially equal to the diameter of the roller 16. The cap, however, is provided with a curved outer end, such that there are no sharp outer edges on the roller cap. A passage 330 extends axially through the roller cap 328 and opens into a counter-sunk portion 332 in the outer end of the cap 328. The axles 312 are sized to extend through cap passage 330 such that the axle threaded end 314 is exposed in the counter sunk portion 332. A nut 334 is received on the end of each axle 312 to secure the roller caps on the end of the axles. The counter sunk section 332 is sized, as seen in FIG. 18, such that the surface of the nut is substantially flush with the end surface of the cap. The countersunk section 332 can be shaped to correspond in shape to the circumferential shape of the nut 334, such that the nut 334 will be positionally fixed in the cap 328.

When assembled, the brackets 302 are positioned in the side glide pocket, such that the inner surfaces of the legs will be adjacent the opposite ends of the central roller 16. The axles 312 and the caps 328 are sized, such that when the caps 328 are on the axles 312, the inner ends of the caps will be substantially adjacent the outer surface of the bracket legs 308. This will reduce the gap between the bracket legs 308 and the roller 316 and the cap 328, to thereby reduce the axial play in the roller assembly. Because the central roller and roller cap are frictionally received on the axle 312, and because the axle 312 is sized to rotate freely in the leg opening 310, the roller 316 and roller caps 328 can rotate relative to the brackets 302.

The dock section 10 and extension 130 are both one-piece modules each having a minimum of movable parts. Because they are one-piece, the modules or dock sections are easily connected together or to an existing dock, to form a dock system. Further, the extension allows for the size of the watercraft dock to be easily increased to enable the watercraft dock to receive larger watercraft. Further, because the rollers are the only movable parts on the watercraft dock, and because they are easily replaced, as noted above, repair of the watercraft dock and extension is easily performed.

When a watercraft is to be docked in a dock made from the dock section 10 (with or without the extension 130), the driver idles the watercraft up to the back of the dock to align the watercraft with the watercraft receiving area of the dock. The driver then eases the watercraft into throttle. This will urge the watercraft forward, and the watercraft will slide up the ramp of the dock and onto the glide assembly at the back of the dock. The inertia or momentum of the watercraft as it is urged on to the glide assembly will carry the watercraft forward, even when the engine is out of the water. The watercraft receiving area 30 is, as noted above, shaped to correspond generally to the shape of a watercraft hull. Hence, as the watercraft is urged into the watercraft receiving area, the alignment of the watercraft relative to the watercraft receiving area will be corrected, as may be necessary. After the watercraft has been secured to the dock, the air bladders 114, if provided, can be inflated to raise the dock to ensure that the watercraft is out of the water.

As can be appreciated, when the watercraft is driven onto the dock, the weight of the watercraft will cause the rear of the dock to lower in the water, and the dock may take on a slight canter. As discussed above, connection between the extension 130 and the dock section 10 is a rigid connection. Hence, for a dock provided with an extension 130, when the watercraft is driven onto the dock, the complete dock (i.e., the extension and the dock section 10) will take on a slight canter. The extension 130 will not flex, pivot, or otherwise move substantially relative to the dock section 10.

As various changes could be made in the above constructions without departing from the scope of the invention, it is intended that all matter contained in the above description or shown in the accompanying drawings shall be interpreted as illustrative and not in a limiting sense. Although the dock is described for use with small watercraft, it could be modified for use with larger watercraft if so desired. Although the connector socket 24 and the connector disclosed in the above noted U.S. Pat. No. 5,281,055 is preferred to connect the extension to the dock, any conventional type of connecting mechanism can be used to connect the extension to the dock. The rollers of the bottom roller assembly 72 could be replaced pads which, like the rollers, would enhance the ability of the watercraft to move along the length of the dock. Although the extension and dock section are shown with both roller assemblies 72 on the bottom surface and glide assemblies 42, 42*a* on the wall surfaces, one or even both could be omitted. Hence the dock section and extension could be provided with just the bottom roller assembly or just the side wall glide assembly, or they could be provided with neither the bottom roller assembly nor the side wall glide assembly. Although the glide assembly 300 is shown with two axles 312, the glide assembly 300 could be provided with a single axle 312 which would extend the length of the roller assembly. These examples are merely illustrative.

The invention claimed is:

1. A floating drive-on watercraft dock comprising:

a body having an upper surface, a lower surface, and front, back, and side surfaces extending between said upper and lower surfaces; said upper, lower, front, back and side surfaces defining a volume;

a watercraft receiving area formed in said upper surface; said watercraft receiving area being open at said back surface; said watercraft receiving area comprising an entrance section extending forwardly from said body back surface and a main section extending forwardly of said entrance section;

said watercraft receiving area main section including a bottom surface and sidewalls extending from said watercraft receiving area bottom surface to said body upper surface; at least one pair of opposed pockets formed in said watercraft receiving area side walls;

said watercraft receiving area entrance section including a sloped ramp; sidewalls extending from a bottom surface of said watercraft receiving area entrance section to said body top surface; opposed side wall pockets on said entrance section side walls; and side wall glide assemblies received in said side wall pockets; the side wall glide assemblies comprising a mounting member secured in said side wall pocket; a bracket securable to said mounting member at a selected position along said mounting member; and a glide member mounted to said bracket at a selected position along said bracket to position said glide member a selected distance from said mounting member.

2. The floating drive-on watercraft dock of claim 1 wherein said mounting member comprises an elongate beam having a plurality of openings therein; said bracket comprising a lower portion and an upper portion; said bracket lower portion comprising at least one opening alignable with a selected one of said mounting member openings; said glide assembly including a fastener which extends through said bracket lower portion opening and said mounting member opening to secure said bracket to said mounting member; said bracket upper member including a plurality of openings extending in a direction transverse to said mounting member beam; said glide assembly including a second fastener received in a selected one of said bracket upper portion openings to secure said glide member to said bracket at a desired distance from said mounting member beam.

3. The floating drive-on watercraft dock of claim 2 wherein said glide member is pivotally mounted to said bracket; said glide assembly second fastener comprising a pin received in said bracket upper portion opening and about which said glide member can pivot.

4. The floating drive-on watercraft dock of claim 2 wherein said glide member comprises an axle mounted to said bracket and rollers positioned at opposite ends of said axle.

5. The floating drive-on watercraft dock of claim 4 wherein said axle comprises a center section mounted to said bracket; extension sections extending upward from opposite ends of said center section; end arms extending outwardly from ends of said extension sections; and rollers mounted on said axle end arms.

6. The floating drive on watercraft dock of claim 2 wherein said glide member comprises a pad mounted to said bracket.

7. The floating drive-on watercraft dock of claim 2 wherein said mounting member comprises a base plate sized and shaped to be received in said side wall pocket and a bar on an upper surface of said base plate; said bracket being mounted to said bar.

8. The floating drive-on watercraft dock of claim 1 wherein said body upper surface defines a deck surface extending along at least the sides of said watercraft receiving area.

9. The floating drive-on watercraft dock of claim 1 including at least one bottom pocket positioned along said watercraft receiving area bottom and a bottom glide assembly received in said at least one bottom pocket.

10. The floating drive-on watercraft dock of claim 9 wherein said dock includes opposed shoulders on opposite sides of said at least one bottom pocket; there being at least one groove in said shoulders; the bottom glide assembly comprising an axle, the opposed ends of which are removably secured in said shoulder grooves; and at least one roller mounted on said axle.

11. The floating drive-on watercraft dock of claim 10 wherein said bottom glide assembly includes a plate sized to be received on said bottom pocket shoulder and to extend over said axle; said plate being secured to said shoulder to secure said bottom glide assembly in place.

12. The floating drive-on watercraft dock of claim 10 wherein said glide assembly comprises two spaced apart rollers which are positioned on said axle.

13. The floating drive-on watercraft dock of claim 1 wherein at least one of said glide assemblies comprises a pair of base members sized and shaped to be positioned in spaced apart side pockets of said watercraft receiving area, a rail extending between said base members; and a plurality of spaced apart glide members mounted along said rail.

14. The floating drive-on watercraft dock of claim 13 wherein said glide members comprise rollers.

15. The floating drive-on watercraft dock of claim 1 including a inflatable bladder assembly positioned at said body bottom surface.

16. The floating drive-on watercraft dock of claim 15 wherein said body bottom surface includes a plurality of compartments positioned along the sides of said body bottom surface; said bladder assembly including inflatable/deflatable bladders positioned in said compartments.

17. The floating drive-on watercraft dock of claim 16 including a compressor operatively connected to said bladders to inflate said bladders.

18. The floating drive-on watercraft dock of claim 1 further comprising an extension unit; said extension unit comprising an extension body and a tongue extending from a forward surface of said extension body; said tongue having a bottom surface corresponding in shape to at least a back portion of the entrance section of said dock watercraft receiving area.

19. The floating drive-on watercraft dock of claim 18 wherein said extension unit includes an upper surface and a watercraft receiving area in said extension upper surface; said extension watercraft receiving area defining an entrance to said dock watercraft receiving area and including a ramp; a bottom pocket adjacent a top edge of said ramp and a bottom glide assembly mounted in said bottom pocket; side wall pockets formed in opposed side walls of said extension watercraft receiving area and side wall glide assemblies mounted in said side wall pockets.

20. In combination, a floating drive-on watercraft dock and an extension unit connectable thereto;

said floating watercraft dock comprising a body, a watercraft receiving area formed in an upper surface of said body and being opened at a back surface of said body; said watercraft receiving area comprising an entrance section extending forwardly from said body back surface and a main section extending forwardly of said entrance section; said entrance section comprising a ramp; said ramp being shaped and configured to guide a watercraft into said watercraft receiving area main section;

said extension unit comprising an extension body and a tongue extending from a forward surface of said extension body and a ramp at a back of said extension body; said tongue having a bottom surface corresponding in shape to at least a back portion of the entrance section of said dock watercraft receiving area such that said extension unit tongue can be received in at least said back portion of said dock watercraft receiving area; said ramp being shaped and configured to guide a watercraft into the watercraft receiving area of said watercraft dock.

21. The combination of claim 20 wherein said body and extension entrance sections comprise an outwardly flaring wall extending along at least a part of said ramp.

22. The combination of claim 20 including a connector for connecting said extension unit to said dock.

23. The combination of claim 22 wherein said dock includes connector sockets at a back of said dock body and said extension including connector sockets at a front of said extension body; said connector sockets of said dock body and extension body be positioned to be aligned with each other; said connector having opposed ends received in said aligned connector sockets; said connector and connector socket being shaped to substantially prevent axial movement of said dock extension relative to said dock body.

24. The combination of claim 20 wherein said dock include includes glide assemblies positioned along at least one of the bottom and wall of the watercraft receiving areas of said dock.

25. In combination, a floating drive-on watercraft dock and an extension unit connectable said floating watercraft dock comprising a body, a watercraft receiving area formed in an upper surface of said body and being opened at a back surface of said body; said watercraft receiving area comprising an entrance section extending forwardly from said body back surface and a main section extending forwardly of said entrance section; said entrance section comprising a ramp;

said extension unit comprising an extension body and a tongue extending from a forward surface of said extension body and a ramp at a back of said extension body; said tongue having a bottom surface corresponding in shape to at least a back portion of the entrance section of said dock watercraft receiving area; said ramp being shaped and configured to guide a watercraft into the watercraft receiving area of said watercraft dock said dock body further including at least one pair of opposed pockets formed on side walls of said watercraft receiving area and a glide assembly secured in each of said opposed pockets; said glide assembly including a mounting member, a bracket, and a glide member; said mounting member and bracket being adapted to enable said bracket to be secured to said mounting member at a selected position along said mounting member; and said glide member being mountable to said bracket at a desired position along said bracket to be spaced a desired distance from said mounting member.

26. An extension member for a floating drive-on dock; the said extension member comprising:

an extension body, said body having front, side, back, top and bottom surfaces; said body being open at said back surface to define an entrance to said extension member; and a ramp extending forwardly from the back of said extension body; and a tongue extending forwardly from said body front surface; said tongue having a bottom surface which slopes upwardly from a base of said tongue to a free end of said tongue and which slopes upwardly from a middle portion of said tongue to side edges of said tongue, such that said tongue is narrower at its said free end than at its base and such that said tongue is narrower at its sides than at a middle section of said tongue; whereby said tongue is shaped to be received in an entrance section to a watercraft dock member.

27. The extension member of claim 26 including an aft glide assembly mounted to said extension body back surface at a base of said ramp.

28. The extension member of claim 26 further including a watercraft receiving area extending forwardly from entrance; said ramp being at a back end of said water craft receiving area.

29. The extension member of claim 28 wherein said tongue includes a channel section aligned with said body water craft receiving area.

30. An extension member for a floating drive-on dock; the said extension member comprising:

an extension body, said body having front, side, back, top and bottom surfaces; said body being open at said back surface to define an entrance to said extension member; a watercraft receiving area extending forwardly from entrance, and a ramp at a back end of said water craft receiving area; said ramp extending forwardly from the back surface of said extension body;

a tongue extending forwardly from said body front surface; said tongue having a bottom surface which slopes upwardly from a base of said tongue to a free end of said tongue, such that said tongue is narrower at its said free end than at its base; and at least one pair of opposed pockets formed on side walls of said watercraft receiving area and a glide assembly secured in each of said opposed pockets; said glide assembly including a mounting member, a bracket, and a glide member; said mounting member and bracket being adapted to enable said bracket to be secured to said mounting member at a selected position along said mounting member; and said glide member being mountable to said bracket at a desired position along said bracket to be spaced a desired distance from said mounting member.

31. The combination of claim 20 wherein said extension includes a watercraft receiving area in said extension upper surface; said extension watercraft receiving area including a ramp.

32. The combination of claim 31 wherein said extension unit includes glide assemblies positioned along at least one of the bottom and wall of the watercraft receiving areas of said extension unit.

* * * * *